US011613141B2

(12) United States Patent
Tuszynski

(10) Patent No.: US 11,613,141 B2
(45) Date of Patent: Mar. 28, 2023

(54) BINDING DEVICE FOR PAPER AND OTHER ITEMS

(71) Applicant: Jacek Tuszynski, Elmwood Park, IL (US)

(72) Inventor: Jacek Tuszynski, Elmwood Park, IL (US)

( * ) Notice: Subject to any disclaimer, the term of this patent is extended or adjusted under 35 U.S.C. 154(b) by 84 days.

(21) Appl. No.: 16/746,300

(22) Filed: Jan. 17, 2020

(65) Prior Publication Data

US 2021/0221161 A1 Jul. 22, 2021

(51) Int. Cl.
*B42F 13/04* (2006.01)
*B65D 63/10* (2006.01)

(52) U.S. Cl.
CPC ..... *B42F 13/04* (2013.01); *B65D 63/1018* (2013.01)

(58) Field of Classification Search
CPC ..... B42F 13/04; B42F 13/02; B42F 3/06
USPC ..... 402/57, 8
See application file for complete search history.

(56) References Cited

U.S. PATENT DOCUMENTS 2,042,366 A * 5/1936 Swank ..... B42F 13/02 402/13
2,773,504 A * 12/1956 McGervey ..... B42F 13/04 402/8
3,246,653 A * 4/1966 Sexton ..... B42F 13/165 402/15
3,507,601 A * 4/1970 Smith ..... B42F 13/02 402/8
3,791,747 A * 2/1974 Grundell ..... B42F 13/02 402/8
4,174,909 A * 11/1979 Jahn ..... B42F 13/10 402/13
4,192,620 A * 3/1980 Jahn ..... B42C 7/002 402/15
4,256,411 A * 3/1981 Podosek ..... B42F 13/06 402/13
4,437,781 A * 3/1984 Weihe ..... B42F 13/02 402/8
4,697,945 A * 10/1987 Geiger ..... B42C 7/00 402/75
4,940,352 A * 7/1990 Kratzert ..... B42F 13/10 402/13
5,123,675 A * 6/1992 Staats, III ..... B42F 13/06 281/21.1
10,500,890 B2 * 12/2019 Busam ..... B42F 13/02
2003/0077108 A1 * 4/2003 Menahem ..... B42F 15/0064 402/8
2011/0200411 A1 * 8/2011 Aoi ..... B42F 13/06 412/16

* cited by examiner

*Primary Examiner* — Robert Sandy
*Assistant Examiner* — Rowland Do
(74) *Attorney, Agent, or Firm* — Quarles & Brady LLP

(57) ABSTRACT

A binding device for hole-punched paper and other items can be made from a sheet of material without necessarily requiring metal or plastic parts. The device can include a tie and an arrangement of openings cut in a sheet of material to secure the tie in place and withstand the load of bonded hole-punched paper or other items. Some devices can exhibit flexible thickness, adjusting automatically to the thickness of items being bonded.

20 Claims, 18 Drawing Sheets

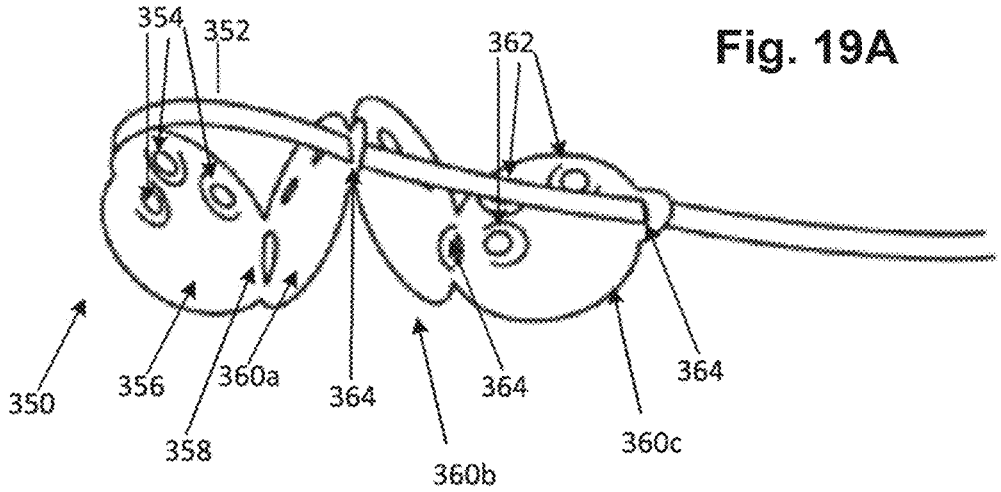
Fig. 19A
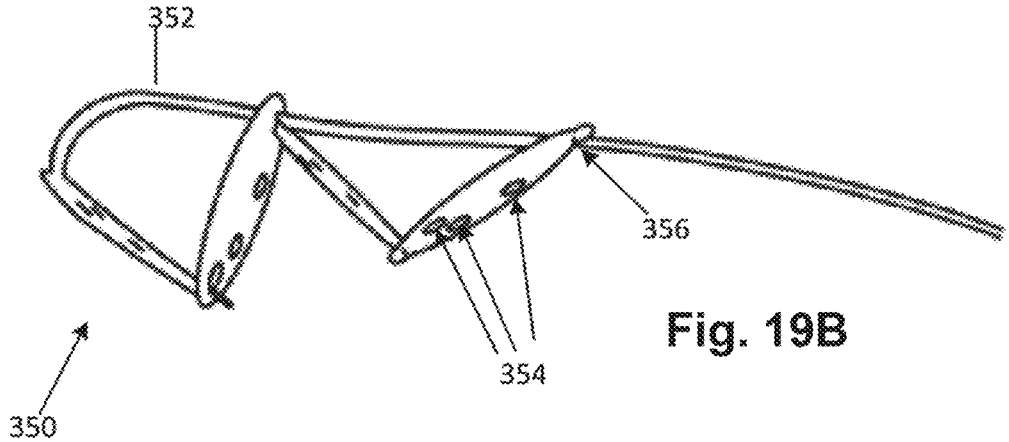
Fig. 19B
Fig. 19C
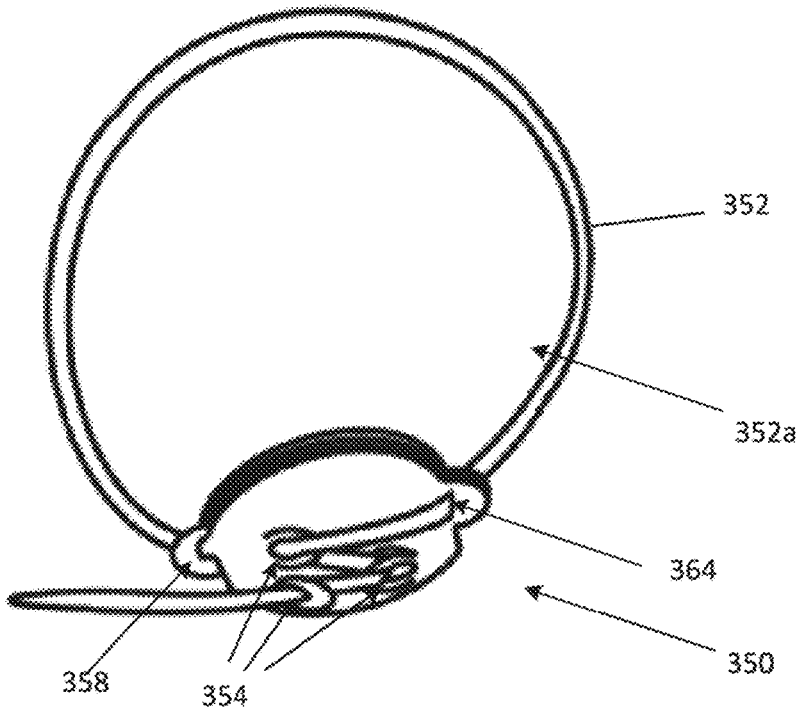

BINDING DEVICE FOR PAPER AND OTHER ITEMS

BACKGROUND

Ring binders hold, and store punched sheets of paper and other suitably hole-punched materials. Typically, ring binders use rigid rings to hold paper and a locking/release mechanism for the rigid rings that include a thumb- or finger-operated latch. Other styles of portfolios can use features such as large pockets to receive a portion of a paper, pressure-sensitive adhesive for retaining the bound edge of bound paper, or a plurality of sockets, each socket being adapted to receive the tongue of a bound pad of paper.

SUMMARY OF THE INVENTION

At the heart of some embodiments of the present invention is the inventor's discovery that it is possible to have a binding device made from a flexible sheet of material without necessarily requiring any rigid metal or plastic parts. It is possible to create a binding device that can adjust its thickness automatically to the thickness of the items that it binds and use the flexibility and stiffness of the material from which it is made to bind a bundle of items. It is possible to create a binding device that does not excessively exceed the exterior dimensions of the items it binds and easily adjusts its thickness every time a user adds or removes hole-punched paper or other items.

Some embodiments of the invention provide a binding device for securing hole-punched paper or other items. The binding device can include a tie formed from a flexible sheet of material, the first opening in a flexible sheet, and a second opening in the flexible sheet. The tie can be configured to secure the hole-punched paper or other items by extending along the flexible sheet in a first direction, passing through the first opening, extending along the flexible sheet in a second direction that is at an acute angle relative to the first direction, from the first opening to the second opening, and passing through the second opening. In some embodiments, hook-and-loop fasteners, glue, or other fastener arrangements that can secure the tie can be used instead of the second opening.

In some embodiments, a tie can be flat, have opposite edges, and can be formed from a flexible sheet of material, and a flexible sheet substrate (e.g., formed from the same flexible sheet of material as the tie) can include a first opening. The tie can be configured to secure hole-punched paper or other items by extending along a first side of the flexible sheet in a first direction, passing from a first side of the flexible sheet through the first opening, and bending at an acute angle at the opening so that the opposite edges of the tie engage inner edges of the first opening to secure the tie at the first opening.

Some embodiments of the invention provide a method for manufacturing a device for binding hole-punched paper or other items. A binding can be made from a single sheet of flexible sheet material. The binding device can include a flexible sheet of material, a tie formed as a ribbon of the flexible sheet material, and a first opening in the flexible sheet. The tie can be configured to secure the hole-punched paper or other items by extending along a first side of the flexible sheet in a first direction, passing through the first opening, and extending along a second side of the flexible sheet in a second direction that is acutely angled relative to the first direction, such that the tie bends at an acute angle at the first opening, and opposite sides of the tie engage an inner edge of the opening. The method can further include providing at least one of a second opening, formed in the flexible sheet material, to secure the tie at the acute angle, or a separately formed fastener configured to secure the tie at the acute angle.

BRIEF DESCRIPTION OF DRAWINGS

FIGS. 19A through 19C show aspects of operations to secure material using a binding device according to an embodiment of the present solution.

DETAILED DESCRIPTION

Figure 1:
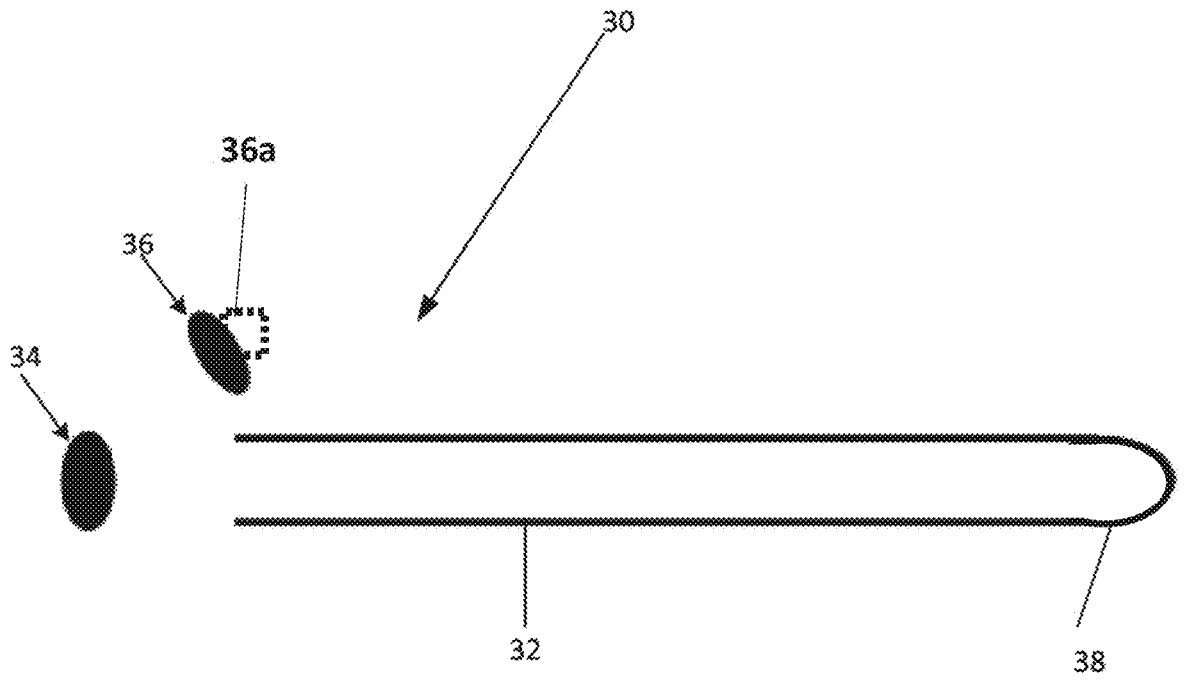
FIG. 1 shows a schematic view of a binding device in accordance with an embodiment of the present solution in a fully uncoupled state.

This description first presents some tutorial material related to binding.

The document binding solutions that are currently available on the market use expensive binding equipment and a variety of plastic or metal rings, springs, plastic combs arrangements forming spines, etc. in order to keep documents together. None of the solutions has its spine adjust itself to the thickness of the documents it contains. Fixed dimension spines and thick covers increase a binder's thickness above its nominal capacity available for documents. The available binding devices are normally not filled up to their full capacity, which causes their open ends to be narrower than their spines. This uneven shape presents storage problems, as it does not allow efficient use of storage space. The sharp edges of metal parts can cause painful injuries. Plastic and metal parts have a high carbon footprint and are difficult to recycle.

As a solution to these and other issues, this disclosure presents embodiments of a flexible binding device. In some embodiments, it is possible to have a binding device made from a biodegradable, flexible sheet of material without rigid metal or plastic parts involved. Such a binding device may be capable of adjusting its thickness automatically to match the thickness of materials bonded and not exceed significantly over the thickness of said materials.

To do that, a flat sheet of material may be used, with stiffness and flexibility that is similar to the stiffness and flexibility of paper. However, this does not mean that embodiments herein are limited to paper. Due to the well-known characteristics of paper, paper is discussed herein as an example. There are scores of other materials with similar physical characteristics but that are significantly more resistant to forces tearing them apart than paper. As an example a product available under the generic name of "Synthetic Paper" may be used, including biodegradable synthetic paper, as well as other materials, including metals, foil, fabric, and plastics, as well as combinations of suitable materials.

For example, known characteristics of paper allow the use of paper to support heavy loads, when the gravitational force of the load applied align in a parallel direction to the direction of the surface of the piece of paper. Because it is sometimes difficult to have a perfectly aligned flat piece of paper to support a heavy load, paper is sometimes used in a waved form known as corrugated paper, such as to construct storage boxes. Corrugated paper is fabricated from a sheet of paper forming waves. In other words, changing a sheet of paper's directions in order to reinforce the paper, and thanks to that, the amazingly thin walls of corrugated paper that most shipping boxes are made from can support a heavy load.

This strength of a deformed flexible sheet of material can be employed in embodiments of the disclosed binding device. For example in manufacturing a device according to some embodiments: first, a tie is cut from a flexible sheet of material, then at least two openings are cut in the same sheet, with their width close to the width of the tie. One of the openings is located by the attached end of the tie, cut in the same piece of flexible sheet of material and there is also a second opening cut on the side of the attached end of the tie in such arrangement that the free end of the tie when penetrating the first opening must emerge in acute direction to its previous direction in order to reach and penetrate the second opening. The tie penetrates the first opening and then proceeds in a return direction that creates at the bending point an area of strength and stiffness similar to the wave formed in corrugated paper. When the tie, after bending, proceeds in the opposite, 180-degree direction to its previous direction, the bent area has increased stiffness in the direction perpendicular to the direction of length of the tie.

Initially, the existence of such 'bent,' stiff, and strong (hard to crush) area does not provide a stopping force that prevents the tie from releasing from the opening since the separating force is parallel to said tie, and the tie is flexible in this direction. To have a braking effect, it may be appropriate to direct the separating force to act against the nonflexible, bent area of the tie. Again the stiff and hard to crush area of the tie is stiff and hard to crash only in the direction perpendicular to the length of the tie. This means the breaking force should be applied to the side of the tie at the bending point, as may be achieved by directing the tie to the side with an acute angle to its previous direction after it penetrates the first opening.

The separating force is still working in the same direction, parallel to the general direction of the tie, but now the acute angle of the bent area is exposing a hard, bent edge area against the edge of the penetrated opening, pressing hard against said edge and stopping tie from moving in the direction of the separating force. The tie at the bent point can form a hard, nonflexible structure that acts as a nonflexible brake when it presses against the edge of the opening. To make the stopping effect permanent, the second or next opening (or a fastener in place of that opening) can be used to secure the tie permanently in an acute direction to the previous direction of the tie.

There is also a second force that can increase the engagement of the binding device. To increase the grip of the binding device, its stiffness can again be applied from another direction. If, for example, the tie is formed from fabric, fabric alone has no inner stiffness and is not able to resist a separating force when pulled out from the opening. When instead of fabric, stiff but still flexible sheet material can be used to form the tie, when the tie is pulled out at an angled direction, relative to its previous direction, the tie will not slide out of the opening but instead lifts the material into which the opening is cut. Its stiffness does not allow bending at a sharp angle. To do that, excessive force must be applied, damaging the inner structure of the material that the tie is cut from, to form a crease, and overcome stiffness, normally allowing only wide-angle bending.

For example, the tie can be cut from paper and bend it into the shape of the letter "L" with the bottom arm of the "L" set flat, horizontally on the ground. Then the second piece of paper can be inserted with an opening penetrated by the vertical arm of the letter "L," and this second piece of paper lies horizontally on the top of the bottom horizontal arm of the "L". Then, when trying to remove the "L"-shaped tie by pulling up the vertical arm of "L", instead of pulling the tie out of the opening the horizontal penetrated piece is lifted. This happens because the stiffness of the material the tie is cut from is greater than the force applied.

Using only this type of gripping power with direction comparable to the gripping direction of a plier, one may use a tie formed from sections of marginally flexible or non-flexible material with hinges or other flexible connections in between, like for example crease to bind any material, with the same arrangement of holes as described above, to allow smooth penetrations of the holes by the tie. With the free end of the tie secured in place by penetration of the second hole or by use of a fastener or glue instead, a user may have a fully functioning binding device, with slightly different handling than the handling of the binding device with a full-length flexible tie. The gripping power of the binding device is generated by the use of the stiffness of material from which the tie is cut.

Continuing the discussion above regarding the use of flexible material: a configuration with two guiding openings may be limited in the amount of the material it can bind, because if the first angle of entry of the tie in the first opening is not acute, the solution will not work. When the tie is used to bind a thicker load of material, as the tie's angle of entry to first hole approaches 90 degrees, the gripping power becomes weaker. When the angle of entry is close to 90 degrees, the breaking power effectively ceases to exist. The "brake" function will not be formed. In this situation, the strength of the binding device may be increased by multiplying the number of openings penetrated by the tie. Each opening located in such an arrangement that the tie after penetrating the previous opening proceeds in almost return direction with an acute angle to the previous direction into the next opening. More openings may be added, to be penetrated by the tie, directed each time to the next opening under an acute angle to its previous direction, forming this way more gripping power each time tie is bent when penetrating the next opening.

The gripping power of the binding device can be increased by the use of rigid, nonflexible material to make the clasp or, in other words, the arrangement of openings designed to retain the tie.

The binding device described above, including the tie, is cut from a single sheet of flexible material, but a tie and a separate substrate with openings may also be assembled as separate pieces made from other suitable materials. Further, the last opening securing the free end of the tie in an acute position to its previous direction may be replaced in some embodiments with a fastener, including a hook-and-loop fastener, a clasp, hooks, rings, glue strips, etc. The other openings may be made similarly.

The example above described a binding device made from a flexible sheet of material, but another embodiment may have parts made from nonflexible material. For example, parts with openings or attached flaps with openings may be made from nonflexible material. The binder described may have different forms like for example document binder with covers as well a binder with multiple ties and arrangements of openings attached to a spine as well as a binder consisting of single ties with arrangements of openings attached, as well as other shapes and arrangements as different uses and situations may suggest.

In some embodiments, as alluded to above, it may be useful to form one or more of the openings for a tie on flaps that extend away from a main part of the substrate material. For example, the tie in the above arrangements is penetrating the openings, each time crossing to the other side of the sheet made from a flexible sheet of material. Because it may pose a problem when there is not easy access to the full length of the tie from one side of the substrate, flaps can be used. Flaps may be folded somewhat away from an associated flexible sheet. Flaps may be made in the form of openings separated on 2 or 3 sides from the rest of the material or materials that the binding device is made from or in the form of an attachment with an opening inside, made from other materials. This arrangement allows the tie to stay on one side of the sheet of material that the binding device is made from and be always accessible from one side after it penetrates an opening.

Embodiments of the present Invention was specifically designed to bind hole-punched paper but is capable of a more general application as a lock wherever a flexible tie arrangement coupling with a clasp consisting of holes or flaps with holes may replace locks used in bags, belts, shoes, closing of seams uniting flexible or nonflexible bodies. The clasps may be made from flexible as well from nonflexible material.

When embodiments of the invention are explained in detail, it is to be understood that the invention is not limited in its application to the details of construction and the arrangement of components outlined in the following description or illustrated in the following drawings.

The invention is capable of other embodiments and of being practiced or of being carried out in various ways. Also, it is to be understood that the phraseology and terminology used herein is for description and should not be regarded as limiting. The use of "including," "comprising," or "having" and variations thereof herein is meant to encompass the items listed after that and equivalents thereof as well as additional items.

Likewise, unless otherwise specified or limited, the terms "mounted," "connected," "supported," and "coupled" and variations thereof are used broadly and encompass both direct and indirect mountings, connections, supports, and couplings. Further, unless otherwise specified or limited, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

Some figures may include multiple instances of similar structures or structural relationships. For convenience of presentation, in select figures, only some of these similar structures or relationships may be specifically labeled with a reference number. One of skill in the art will recognize that the features not labeled with reference numbers can include similar aspects and perform similar functions to similar features that are labeled with reference numbers.

Some embodiments of the invention relate to binding devices, such as those used for securing hole-punched paper or other items. Although some conventional designs can usefully bind hole-punched paper, conventional designs can also exhibit significant deficiencies. For example, as noted above, some conventional binders include rigid rings to hold the hole-punched paper. The rigid and fixed shape of the rings can prevent the binders from being flattened, when not in full use, or expanded, when large amounts of hole-punched paper are to be bound together. Similarly, some conventional portfolios can include pockets or adhesive material. Although some of these designs can be flattened significantly when not in full use, the ability to expand capacity as needed may be limited. Further, some pocket designs may not secure large amounts of paper particularly well. Further, many conventional designs are relatively expensive and complex to manufacture and assemble.

Some embodiments of the invention can address these issues or others. For example, in some embodiments, a binding device can be formed from a single blank (e.g., sheet of flexible material), can be capable of binding hole-punched paper and other items having a wide variety of thicknesses, and can exhibit significant retention strength. In some embodiments, a binding device can exhibit significant retention strength despite being formed from a flexible sheet of material, which may allow for highly economical and straightforward manufacturing and use.

Generally, embodiments of the solution can include a tie and a plurality of openings, all of which can, for example, be formed in (or from) a substrate of a single flexible sheet of material. The tie can be configured to extend through holes punched in a paper (or other materials), then be threaded through the holes to securely retain the hole-punched paper (or other items) as desired. In some embodiments, a tie can be configured to bend at an acute angle at one of the associated openings. This can be useful, for example, to provide substantial gripping strength between the tie and the relevant opening, to prevent forces on the bound hole-punched paper (e.g., from gravity, handling by users, and so on) from easily withdrawing the tie from the opening. In some embodiments, three or more openings can be provided to engage a tie, resulting in at least two acute bends of the tie and correspondingly substantial holding strength. In embodiments with multiple openings, the tie may sometimes be configured to bend at an obtuse angle at one of the openings and acute angles at other openings.

In different embodiments, binding principles disclosed herein (e.g., as described above) can be implemented with regard to a variety of large binding devices. For example, different embodiments can include: a stand-alone binding device in which a single tie is configured to surround at least part of a bound material (e.g., paper); a binding device in which a spine connects multiple distinct sets of openings and an associated tie (each set, generally, also a binding device), such that each tie can surround a different portion of a bound material to bind the material together and to the spine; a portfolio that includes at least one set of openings and an associated tie; and various others.

Some embodiments of the invention can include binding devices (e.g., a set of openings and a tie) that are cut from a single sheet of material, potentially a flexible sheet of material. Some embodiments may not incorporate any additional parts beyond those made from the single sheet of flexible material, including relatively rigid parts such as those made from metal or hard plastic. It can be beneficial, for example, because a tie that is made from the same material as that from which associated openings are cut may be less likely than a tie made from a different material to tear the material surrounding the openings. Additionally, cutting an embodiment of the present solution from a single sheet of material and not adding any additional parts or materials may simplify manufacturing processes, reduce costs, and reduce the time required to complete manufacturing.

As used herein, the term "opening" refers to straight, oval, round, square, rectangle, triangle, trapezoid, or a similarly shaped hole wide enough to allow passing of a tie and narrow enough to keep it from moving to the sides. Certain shapes of hole like straight cut, oval, trapezoid may have increased gripping power effect due to the exposure of a larger area of the penetrated hole's edges to the penetrating tie surface and edges. Other shapes of the holes such as round or square may have lower gripping power. Shapes with parts of the edge extending toward the inside of the hole, for example hole cut in letter "C", may have limited gripping power due to the fact that the shape may not allow full bending of the penetrating tie. As a result, the tie may disengage when a load becomes too heavy for particular arrangement. The term "opening" also refers to hooks and to holes with a side cut allowing access to the inner area of the hole.

As used herein, unless otherwise specified or limited, the term "sheet" refers to a flat piece of material. In some embodiments, a sheet may be substantially planar (e.g., deviating from planar, when resting on a planar surface, only by surface roughness or within acceptable manufacturing tolerances in the industry) and substantially thinner than it is long or wide (e.g., at least two orders of magnitude thinner than its length or than its width).

As used herein, unless otherwise specified or limited, the term "other items" refers to any variety of objects, including, for example, documents, parts, components, and products (i.e., groups of any manner of thing that can be fastened together for handling.)

As used herein, unless otherwise specified or limited, the term "paper" refers to paper as material. In some embodiments, the term refers to sheets of paper that have holes punched through them, for the purpose of securing the sheets in a binder or folder.

As used herein, unless otherwise specified or limited, the term "flaps" refers to features formed on (e.g., of) a sheet of material (e.g., that a binding device is made from) and that remain connected to the sheet but are separated on one or more sides from the sheet, so that the features can be bent away from a main portion of the sheet. For example, some flaps are separated on two or more sides from a flexible sheet substrate and may be folded somewhat away from the flexible sheet. Sometimes flaps may be formed as features in other types of material or devices and attached to the side of the binding device to perform the same function. Rings, clasps, hooks, and other standalone devices with openings can be used as flaps when attached with part of its edge to the side of the binding device. A main function of flaps in some cases is to allow the tie to remain on one side of the binding device, to be easily accessible and not to cross through an opening to the other side of the binding device where the tie may be difficult to reach. Flaps may have exterior shapes that are elongated or corner-like, which may limit or extend their flexibility as needed.

As used herein, unless otherwise specified or limited, the term "cut" refers to the separation of parts or sections of a material (e.g., that a binding device is made from), regardless of the actual method used to make those separations.

As used herein, unless otherwise specified or limited, the term "flexible sheet" is used to refers to a variety of sheet material formulations that can be folded relatively easily (e.g., by hand) and that exhibit sufficient strength to avoid tearing when subjected to the contemplated loads (e.g., the weight of between 5 and 500 sheets of pure paper). As such, a flexible sheet may include conventional paper formed from cellulose or similar materials. It may also include relatively thick materials that are otherwise similar to conventional paper, such materials commonly known as cover paper, card stock, cover stock. It may also include synthetic paper, such as may be formed from synthetic resins, plastic, petroleum derivatives, metals, foils, plastics, and other similar material or as well as from a combination of any of these materials. Further, it may also include a flexible material having desired bending or tensile characteristics (e.g., stiffness and flexibility), such as fabric or laminates. Such flexible materials may sometimes be reinforced with stronger (i.e., more robust or rigid) materials depending on the application. In some instances, a "flexible sheet" may not include pure paper as pure paper may be prone to ripping, depending on thickness and quality. In some instances, pure paper can be supplemented with another material (e.g., fabric, laminate, or other flexible sheet material) to enhance the desired characteristics, reduce susceptibility to ripping and tearing, and allow the pure paper to serve as flexible sheet according to this disclosure.

As used herein, unless otherwise specified or limited, the term "tie" may include a flat strip of material, such as a ribbon cut from synthetic paper or from other flexible material, although other configurations are possible. In some embodiments, a tie may be integrally formed with a flexible sheet of material, such that an end of the tie is integrally attached to material that is not configured as a tie (e.g., a sheet of material configured as a portfolio or cover). In some contexts, a "tie" describes a flexible ribbon-like piece of material tied to rigid a section—as an extension of the tie. Sometimes term "tie" may refer to a flexible tie with a rigid end or a string of narrow, rigid pieces of material flexibly tied to each other.

As used herein, unless otherwise specified or limited, the term "fastener" may refer to any suitable device, clasp, ring, buckle, hook, hook-and-loop fastener, material, or combination of materials for securing, affixing, or adhering a tie to a flexible sheet (or the tie to itself). One such example of a fastener is an adhesive material (e.g., glue), which provides a tacky surface on which the tie will adhere (i.e., bond) in such a manner as to hold the tie with sufficient strength to support a desired operational load. Another example of a fastener is hook and loop (e.g., VELCRO®) fastener. In some such examples, a tie will include the hook or the loop portion of the fastener, while a flexible sheet will include the opposite, such that the tie will be held to the flexible sheet when the fastener portions are in contact. In another example, a fastener can be configured as an eyelet. In such examples, the eyelet may be configured to receive the tie to be configured in such a manner (e.g., wrapped, twisted, knotted, folded, etc.), such that the tie will be held in an acute angle.

As used herein, unless otherwise specified or limited, the term "stiffness" refers to the extent to which a material or object resists deformation in response to an applied force. It is defined as the property of a material, which makes it difficult to bend. In one example, the flexible sheet of material has a characteristic stiffness such that a tie made therefrom resists deformation in response to an applied force in a particular direction (e.g., perpendicular to a thinnest dimension of the tie). In another example, the characteristic stiffness is such that the tie can maintain its shape and form in response to an applied force in a particular direction.

As used herein, unless otherwise specified or limited, the term "flexibility" refers to the extent to which a material or object can bend or deform without cracking or breaking. In one example, a flexible sheet has characteristic flexibility such that a tie made from it may be deformed (e.g., bent double) in response to an applied force without cracking or breaking.

Among other benefits, some embodiments of the present invention can bind a wide range of amounts and sizes of bound items, depending, in some cases, on factors such as the material(s) from which the binding device is composed, the number of openings that the binding device comprises the arrangement of the openings or the dimensions of the tie. In some cases, this may allow relatively simple and compact embodiments of the present invention to replace a large number of relatively complex or sizable conventional binding products. For example, a single instance of some embodiments of the present invention may be able to replace each of a set of ring-binders with sizes ranging from 0 inches to 4 inches, in thickness. A single instance of some embodiments of the present invention may also be able to replace binders with thickness even greater than 4 inches.

Another benefit of the present invention is that some embodiments can maintain a low profile regardless of how much target material they bind. For example, because some embodiments may primarily use a strap-like tie to secure bound material, the overall profile of the binding device and bound material may not extend above or below the top/bottom of the bound material by substantially more than the thickness of the tie. In some cases, this may result in negligible overall protrusion of the binding device, such as when the thickness of the relevant tie is relatively insignificant compared to the total thickness of the bound material.

Notably, in some embodiments, the openings and the tie can be configured to require the tie to bend in a return direction and simultaneously extend at an acute angle at the first opening to after that extend to the second opening. This can result in substantially strong engagement between the tie and the flexible sheet and the first opening, with correspondingly strong securement of the target (now bound) material.

As used herein, the term "first opening" does not necessarily refer to the first opening that a tie passes through. Instead, "first opening" is a labeling term that may not have any ordinal significance. Likewise, as used herein, the term "second opening" does not necessarily refer to the second opening that a tie passes through, but rather is also a labeling term that may not have any ordinal significance. This also applies to subsequent terms that are used to label additional openings, such as "third opening," "fourth opening," etc. For example, "first opening" may refer to opening that a tie passes through before it bends at an acute angle and "second opening" may refer to the next opening that a tie passes through after it has bent at an acute angle, even if the tie has already passed through other openings prior to reaching the labeled openings. However, in another embodiment "first opening" may refer to opening that a tie passes through after it has already bent at an acute angle and "second opening" may refer to the opening that a tie passes through before it bends at an acute angle. In yet another embodiment, "first opening" may refer to opening that a tie passes through at an obtuse angle before bending in an acute angle at "second opening" and "third opening."

For example, in an embodiment where the present solution is implemented in a paper portfolio, the flexible sheet may be the portfolio itself, and the tie and associated openings may all be cut out of the portfolio. During a binding process for a target material, the tie may begin inside the portfolio, then pass through an opening in the target material, after which the tie passes through a first opening cut into the portfolio. As a result, the free end of the tie may now be outside of the portfolio. From there, the tie may be extended (e.g., pulled) along the portfolio towards a second opening cut into the portfolio, and the free end of the tie may be passed back into the interior of the portfolio through the second opening. Due to the arrangement of the openings, the tie may be bent at an acute angle at the second opening, rather than the first, and this bend and the interactions between the edges of the tie and the edges of the second opening (or others) can resist withdrawal of the tie out of the openings.

Although the examples above, and others below, expressly address only two openings, some embodiments may have additional openings through which a relevant tie can be passed, thereby forming additional bends (e.g., additional acute bends). In some cases, these additional openings and bends may beneficially increase resistance to withdrawal of the tie from the openings.

Generally, a flexible sheet for use in embodiments of the solution has sufficient strength, stiffness, and flexibility to be used repeatedly as a tie to secure the desired load (e.g., a desired number of sheets of pure paper).

In one example, the relative thickness of the flexible sheet, or other flexible sheet material, to its width is increased by making a tie having a narrow width. As a result, introducing a bend (i.e., fold, bend line, or fulcrum) in the tie will result in an area of increased stiffness and decreased flexibility. In one example, the bend line can be used to apply a gripping force via friction at an opening in the flexible sheet.

In some embodiments, a binding device can maintain a desired position relative to a flexible sheet by applying a braking force to the flexible sheet. For example, a binding device can include a tie made from a narrow ribbon of a flexible sheet or other suitable material, a pivot point (i.e., fold, bend line, or fulcrum), and braking surface (i.e., edge). In one example, the pivot point is created by the tie penetrating an opening in a first direction and bending in a return direction to form an acute angle at the opening. In such an example, if left in the original bent position (i.e., 180 degrees or directly opposite the first direction), the tie would not apply sufficient force against the edge of the opening to maintain itself in the desired position. However, if the tie is moved to form an acute angle between the first and second directions, the creation of the acute angle in the pivot point of the tie can result in an increase in friction between the tie and the edge of the opening. Thus, due to the increase in friction from reduced contact area between the tie and the edge of the opening, the tie can be prevented from dislodging even under relatively substantial load.

A tie made from a flexible sheet can maintain the bend and act as a binding device even without the tie being affixed at both ends because tie gripping force is created at the bends of the tie, not by affixing the end of the tie to anything.

FIG. 1 shows a binding device 30 according to an embodiment of the solution, with the binding device 30 in a fully uncoupled state. The binding device 30 includes a tie 32 with a leading end 38, a first opening 34, and a second opening 36. In the illustrated embodiments, the tie 32 is configured as a strap. A strap configuration can be highly effective in some cases, as its length can allow embodiments of the present solution to bind relatively large amounts of target material, its width can be readily configured to provide appropriately substantial binding strength (e.g., to bind relatively large amounts of target material without breaking), and its relatively small thickness may allow the relevant binding device to exhibit a relatively small overall profile. Further, a strap can sometimes pass relatively easily through relatively small holes in some target material. In other embodiments, however, other configurations for a tie are possible.

In some embodiments, a tie (e.g., a strap) can be configured to be retained with an acute angle at an opening by features other than another opening. For example, some ties may be sufficiently stiff that the tie naturally remains at an acute angle without other interventions. As another example, a fastener can be provided, such as indicated schematically by fastener 36*a* in FIG. 1. In some cases, a fastener can replace a second (or other opening). For example, in an alternative configuration of the binding device 30, the fastener 36*a* (e.g., an adhesive or hook-and-loop fastener) can be included instead of the opening 36 to secure the tie 32 with an acute angle at the first opening 34. Similar configurations, with fasteners in place of or to supplement openings, can also be implemented with regard to other embodiments contemplated herein, including those embodiments expressly detailed below.

In some embodiments of the present invention, a tie may have a substantially uniform width throughout its entire length. In some embodiments, including some cases in which a tie exhibits a substantially uniform width, a tie may not have any protruding or recessed geometry, such as teeth, lobes, ratcheting mechanisms, or recessed catches, that would engage the edges of the openings or other features and resist the tie from sliding backward. In some embodiments of the present invention, a tie may be tapered on its leading end, to help the leading end of the strap pass more easily through the openings.

Depending on the needs of a particular embodiment, a tie can have practically any length. In some embodiments in which a tie is cut from a flexible sheet, the tie can have a maximum length that is substantially equal to the dimension of the flexible sheet in the direction in which the tie aligns. This design can allow for some ties to have greater lengths than some alternative, conventional designs, in which multiple ties are cut from the same section of the flexible sheet and thus have maximum lengths that may be limited to only a portion of the dimension of the flexible sheet in the direction in which the ties align.

In some embodiments, openings and an associated tie can be cut from the same flexible sheet. In some embodiments, no additional materials or parts are added to a tie or associated openings after the tie or the openings are cut from the flexible sheet. In some embodiments, forming a tie and associated openings from the same material reduces the tendency for the tie to tear the parts of the flexible sheet that form the edges of the opening, including as compared to some conventional configurations where the tie is formed from a material other than the flexible sheet itself. Additionally, forming the tie and the openings from the flexible sheet itself, without any later additions, can simplify the manufacturing process and reduce costs as compared to configurations that require post-cutting modifications to either the tie or the openings.

In FIG. 1, the opening 34 and the opening 36 are both substantially ovular in shape. However, in some embodiments of the present invention, openings can be configured in other ways. In some embodiments, an opening may be substantially round in shape or may have any variety of other geometries. In some embodiments, relatively narrowly shaped openings, such as openings formed as ovals, may help to preserve a relatively large amount of flexible sheet between openings, as compared to a substantially similar arrangement of openings with wider shapes, such as circles. This can help to provide greater strength to resist tearing of the flexible sheet when the tie is loaded.

In some embodiments, an opening in the flexible sheet may have a maximum width (e.g., a diameter of a circle or a major axis of an ovular shape) that is substantially the same as the width of an associated tie. For example, in the embodiment illustrated in FIG. 1, the opening 34 and the opening 36 both have a maximum width that is substantially the same as the width of the tie 32. This type of arrangement may allow a tie to more fully and consistently engage with the edges of an opening, as compared to configurations where the maximum width of an opening is substantially larger than the width of the tie. However, a variety of configurations are possible for different embodiments, and some openings may sometimes be substantially (and usefully) wider than associated ties.

Figure 2:
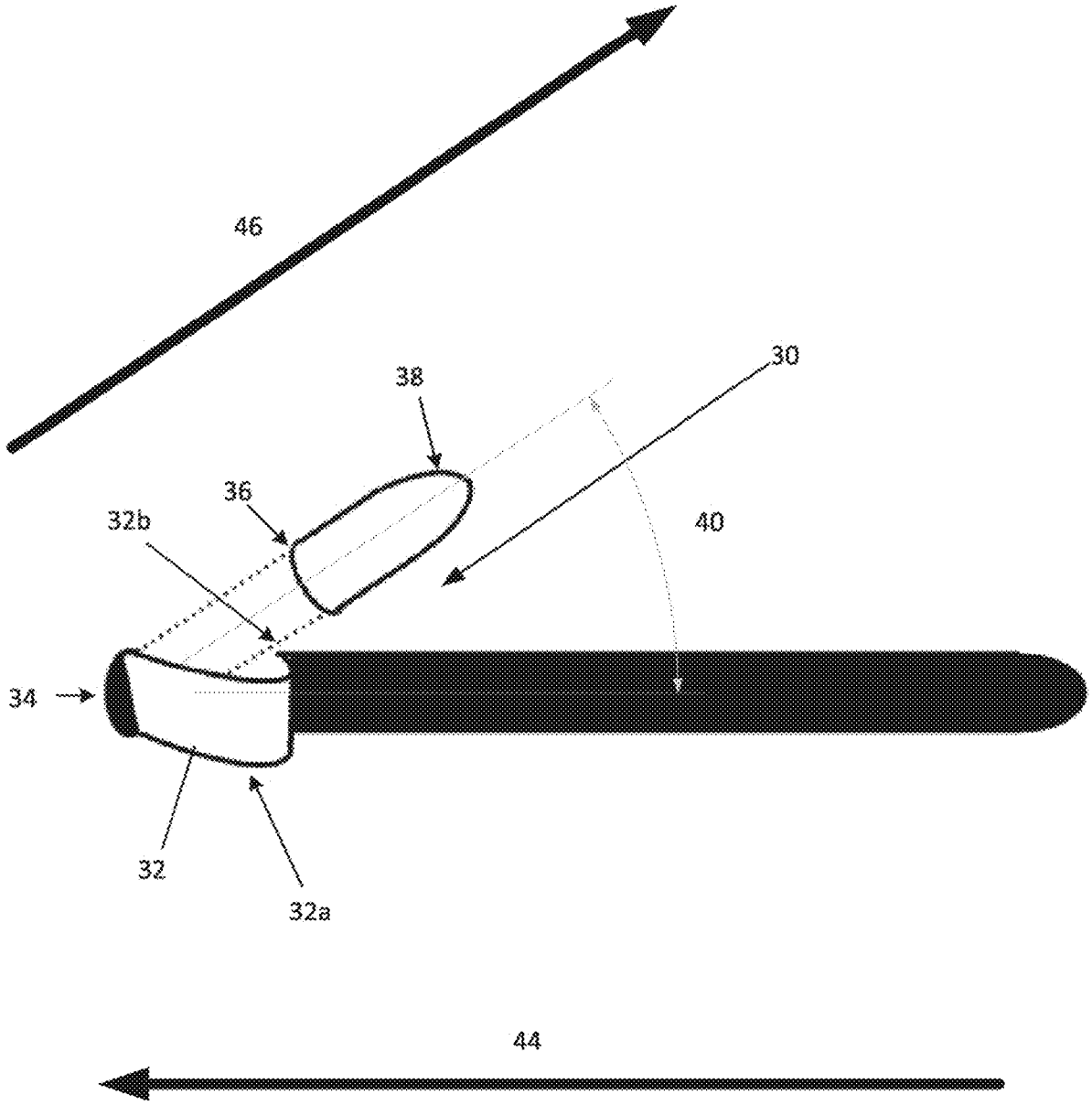
FIG. 2 shows an isometric view of the binding device of FIG. 1, in a fully coupled state.

FIG. 2 shows example operations to secure the binding device 30 around target material (not shown), with the tie binding device 30 illustrated in a fully coupled state. (The tie 32 may need to pass farther through the openings 34 and 36 for the binding device 30 to be in a fully coupled state.) To secure the binding device 30 around target material, the tie 32 can first be bent back along its length (to the left in FIG. 2), then passed in a first direction 44 through the first opening 34. Once the free end 38 and a substantial portion of the tie 32 has cleared the first opening 34, the tie 32 can be bent at an acute angle 40, and extend therefrom along an opposing (e.g., back) side of the flexible sheet, in a second direction 46, towards the second opening 36. The tie 32 can then be passed through the second opening 36 to return to the original (e.g., front) side of the flexible sheet.

Thus arranged, the tie 32 can form a loop 32*a*, of variable size, that can be used to secure bound material. For example, the tie 32 can be threaded through aligned punched holes in stacked paper before being threaded through the first opening 34, so that the paper can be secured at the loop 32*a*. Moreover, because of the acute bend at the opening 34, the tie 32 can be relatively securely held against being withdrawn from the opening 34, so that the paper may remain reliably secured at the loop 32*a*. And the tie 32 (and thereby the paper) can be further secured due to engagement of the tie 32 with the second opening 36, which can help to maintain the acute angle 40 while also directly helping to prevent the free end 38 of the tie 32 from being withdrawn towards the first opening 34. In this regard, for example, it can be seen that the non-alignment of the openings 34, 36 along the first direction 44 can help to preserve an appropriate acute bend of the tie 32 at the opening 34.

In the embodiment illustrated in FIG. 2, the tie 32 is formed with an elongate direction of the tie 32 in alignment with the direction 44 along which the tie must pass from an anchor point 32*b* of the tie to the first opening 34. This may be useful, for example, so that the tie may not be required to twist or bend substantially—other than to form the loop 32*a*—before passing through the opening 34 and forming the associated acute bend. In other embodiments, however, other configurations are possible.

Importantly, in the illustrated embodiments of FIGS. 2, the ties 32, and the openings 34, 36, and are arranged so that the ties 32 must bend at an acute angle as measured substantially within the plane of the flexible sheet. As discussed above, this acutely angled bend can provide substantial resistance to oppose withdrawal of the ties 32, from the relevant openings 34, 36. In contrast, zero degree bends of a tie (e.g., with the tie returning from the opening 34 opposite the direction 44) can provide relatively little resistance against withdrawal. Generally, the more acute the angle (i.e., bend) in a tie (e.g., at an opening), the more resistance the bend can provide to oppose withdrawal of the tie. For example, in some cases, a tie that is bent at a 10° angle, as measured in a direction perpendicular to the plane, may more strongly resist withdrawal than a tie that is bent at a 20°, and so on. Generally, the amount of resistance to withdrawal that is provided by a bend in a tie can continue to decrease as the angle of the bend approaches 90°. However, the angle of the tie, when measured in a direction parallel to a sheet substrate may have an opposite effect, with less acute angles having more gripping power.

Generally, embodiments of the present solution have at least two openings associated with a particular tie (e.g., two openings in a common flexible sheet). This can be useful, for example, to allow a first opening through which a tie passes to provide a pivot point for the tie to bend and to allow a subsequent opening through which the tie passes to provide an anchor point to secure the free end of the tie and help to maintain the angle of the noted bend. As such, some embodiment of the present solution that includes at least two openings can allow a tie to bend at a specific angle and maintain the angle of that bend indefinitely, when in a coupled state. As the specific angle of a bend in the tie can be important in some embodiments of the present invention, the presence of at least two openings to help maintain a particular bend angle can generally be important for effective binding.

Some embodiments of the present solution may be configured to have more than two openings. In some cases, additional openings can allow for additional points of engagement between the tie and the edges of the openings. In some cases, additional openings may also allow for additional bends in the tie, including when the tie is in a fully coupled state. The additional points of engagement between the tie and the edges of the opening and the additional bends in the tie can together help to increase the amount of resistance that prevents the tie from being withdrawn from the relevant holes. And greater resistance in this regard can allow some embodiments to bind relatively large amounts of target material without the tie coming undone.

Different embodiments can have different amounts of space between openings, which can provide different benefits in different contexts. For example, some embodiments with larger amounts of space between openings may sometimes have larger amounts of flexible sheet between those openings, which can provide greater strength to resist tearing of the flexible sheet. As another example, some embodiments with smaller amounts of space between openings can exhibit reduced distance over which a tie must travel between openings, which can leave a greater amount of the length of the tie available to bind target material. With these and other potential benefits in mind, it may accordingly be possible to optimize different embodiments to a wide range of contexts, including as may account for availability of flexible sheet of material to form a tie of a particular length, overall strength of the flexible sheet, expected or required total thickness of bound materials, weight or strength of bound materials, and so on.

Some embodiments of the present solution may have some openings disposed on flaps in the flexible sheet. When a tie passes through an opening that is disposed on a flap of the flexible sheet, it begins on a first side of the flexible sheet, passes through the opening and underneath the flap, and then continues to travel along on the first side of the flexible sheet. The tie remains substantially all on the first side of the flexible sheet both before and after passing through the opening, only traveling behind the portion of the flexible sheet that forms the flap on which the opening is disposed. This configuration allows the tie to remain substantially all on one side of the flexible sheet as it passes through an opening. Among other benefits, this may be beneficial if a particular embodiment seeks to minimize the amount of the tie that is visible on one side of the flexible sheet. It may also simplify the process of passing the tie through the opening.

Embodiments of the present solution can be configured to secure target material in a variety of ways. In some embodiments of the present solution, a tie may sometimes pass through a hole in the target material before coupling with the openings in the flexible sheet. In this way, the tie surrounds a portion of the target material, binding it to the flexible sheet. For example, the target material may be hole-punched paper. A tie of an embodiment of the present solution may begin on one side of the hole-punched paper, pass through the hole in the hole-punched paper, and then proceed to couple with the openings in the flexible sheet. As a result, the tie surrounds the portion of the hole-punched paper between the hole and the flexible sheet and binds the hole-punch paper together and to the flexible sheet.

Some embodiments of the present solution can exhibit a low profile. The low profile exhibited by some embodiments may be related to the type of material from which it is formed, particularly it is formed from a flexible material. In such an embodiment, when a tie binds a target material and couples with the openings, the tie, and flexible sheet do not extend beyond the top or bottom of the target material by substantially more than their thickness, regardless of the pre-existing profile of the target material (e.g., as shown in FIG. 1). In some cases, the thickness of the tie and flexible sheet may be relatively insignificant compared to the profile of the target material, such that relatively strong binding can be provided without adding any substantial thickness to the bound material.

Some embodiments of the present solution may be configured to bind target material other than hole-punch paper. Some embodiments of the present solution may be configured to bind target material to a flexible sheet or to bind together multiple target objects. For example, ties in some embodiments can be configured to surround and secure a bundle of objects, such as electrical cords, before coupling with openings in a small piece of flexible sheet to which the tie is anchored. Such an embodiment could bind the disparate electrical cords together as the tie passes through the openings.

As another example, some embodiments can be used to bind target objects, e.g., rods, to a flexible sheet. In this regard, for example, multiple binding devices on a flexible sheet spine can be configured so that each relevant tie can surround a portion of the rods to bind the rods together and to the flexible sheet collectively. In some cases, this type of arrangement can also include other elements. For example, some embodiments can include a handle (not shown in the Figs.) connected to the flexible sheet, which may facilitate easy transportation of disparate pieces of target material. Some embodiments of the present solution can also incorporate other elements, such as tools to identify or label the target material.

Figure 3:
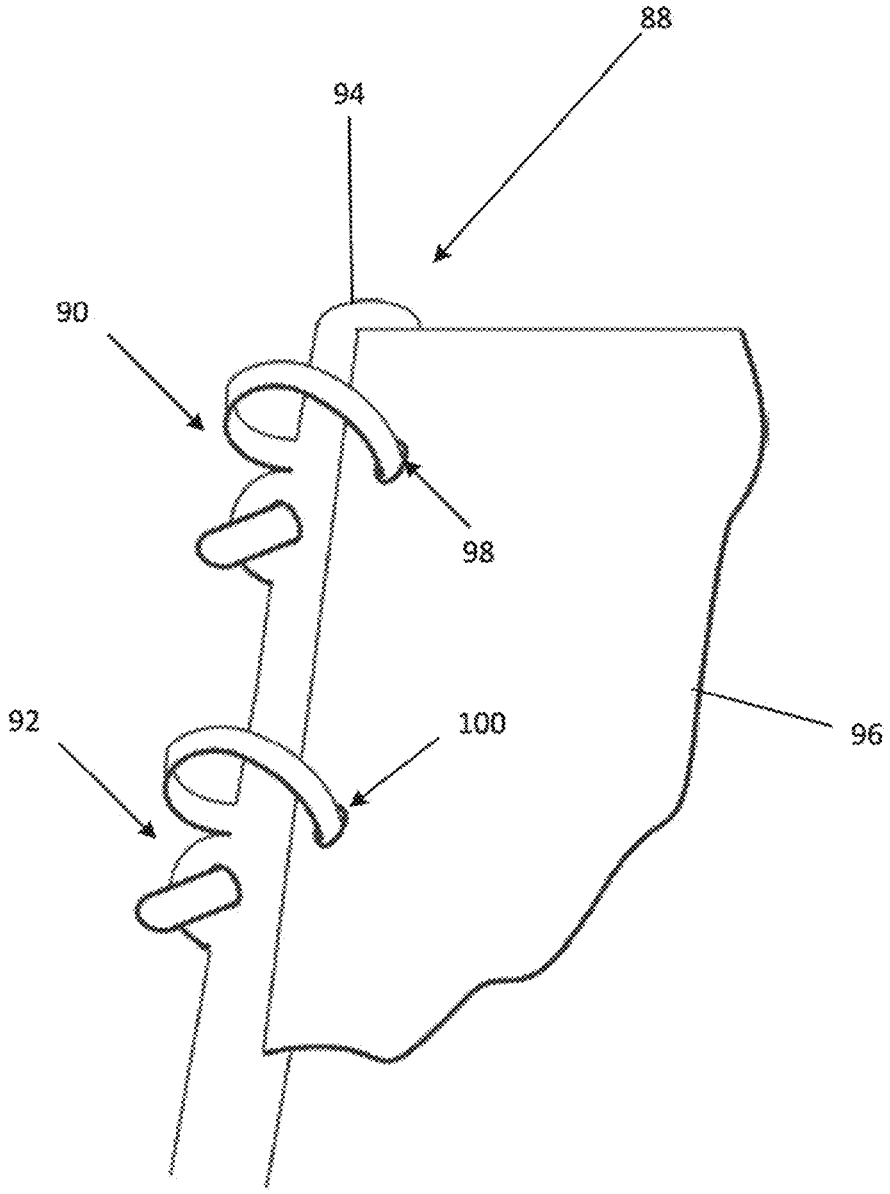
FIG. 3 is an isometric partial view of binding devices formed on a spine, in accordance with embodiments of the present solution.
Figure 4A:
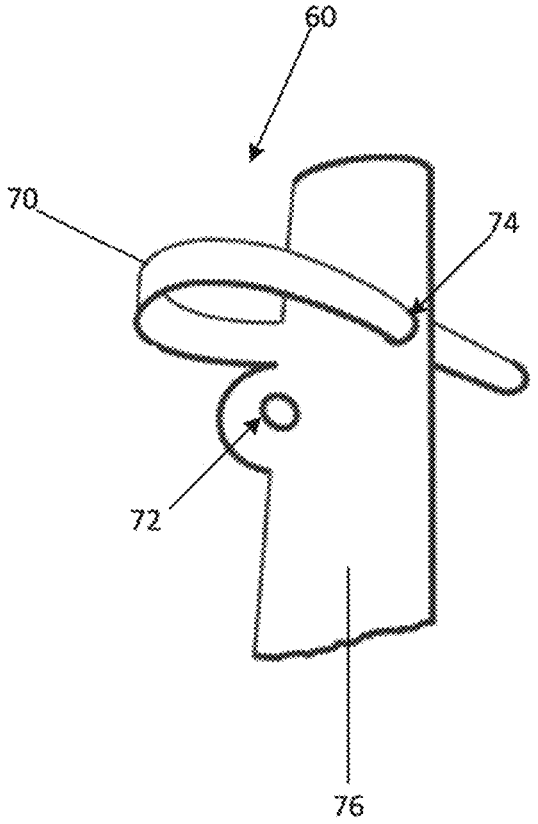
FIGS. 4A and 4B are isometric partial views of a binding device formed as part of a portfolio, in accordance with embodiments of the present solution.
Figure 4B:
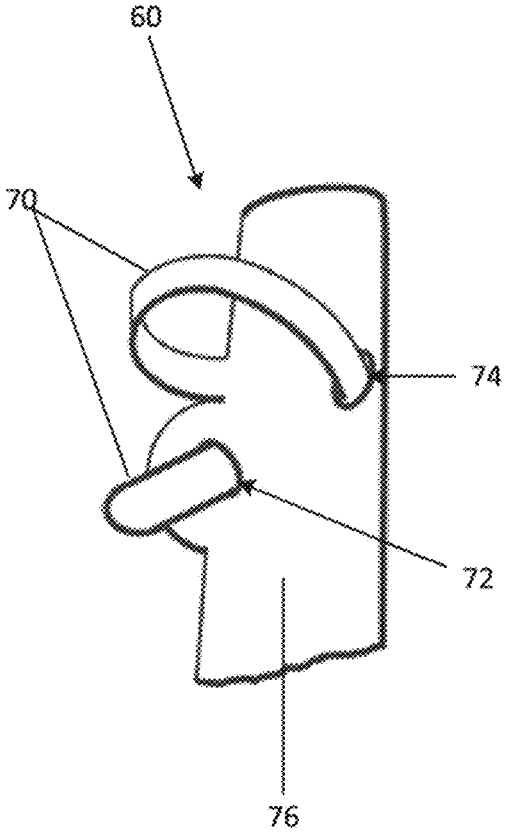

FIG. 3 shows an example binding device 88, according to an embodiment of the present solution, with a spine 94 connects two smaller binding devices 90 and 92. The binding devices 90 and 92 are substantially similar to the binding device 60 of FIGS. 4A and 4B and are formed from the same flexible sheet as the spine 94 (and from which the associated openings are cut). In some embodiments, as also discussed above, the spine 94 and the binding devices 90, 92 can be formed from flexible sheet, as may ensure lightweight and substantial portability as well as economic manufacturing processes.

In the embodiment illustrated in FIG. 3, both of the binding devices 90 and 92 bind the target material 96 (e.g., a paper sheet), so that the target material 96 can be secured to and moved with the spine 94. In this regard, for example, holes 98 and 100 are punched through the target material 96, substantially similarly to standard hole-punched paper. The ties of binding devices 90 and 92 pass through the holes 98 and 100 in the target material 96 before coupling with the openings of binding devices 90 and 92. Usefully, in some embodiments, implementing multiple individual binding devices (e.g., devices 90, 92) in a single larger binding device (e.g., device 88) may increase the amount of target material that can be engaged for binding without ties of the binding devices breaking or being subject to unwanted withdrawal from the relevant openings. Implementing multiple binding devices together may also reduce the risk of damage to the target material, as the retention force for the target material can be distributed among multiple locations. Further, the use of multiple binding devices according to embodiments of the solution can help to avoid unwanted displacement of bound material, such as sliding between paper sheets that are conventionally secured (e.g., with staples) at only a single corner.

Generally, embodiments of the present solution can implement any number of component binding devices, such as one, two, or three individual binding devices. As also discussed above, implementing multiple binding devices on a spine or other linking of a flexible sheet of material can provide particular benefits in some embodiments. For example, in some embodiments of the present solution, each binding device of a set of multiple devices may be able to bind a different portion of the target material, which may increase the total strength with which the target material can be bound.

In some embodiments, using a spine to connect multiple binding devices instead of a larger or more complex structure, such as a portfolio, may have numerous benefits. For example, linking binding devices with an integral (or other) spine may reduce manufacturing time or costs or increase the range of contexts in which the relevant binding devices can be implemented. In some embodiments, using a spine may allow for easy storage, including storage of multiple binding devices (e.g., multiple spines and associated ties) together. In some embodiments, using a spine may provide aesthetic or functional benefits. For example, the relatively small size and concealability of a spine may be useful in cases for which the target material may be aesthetically attractive or may need to be readily and immediately visible.

Figure 2A:
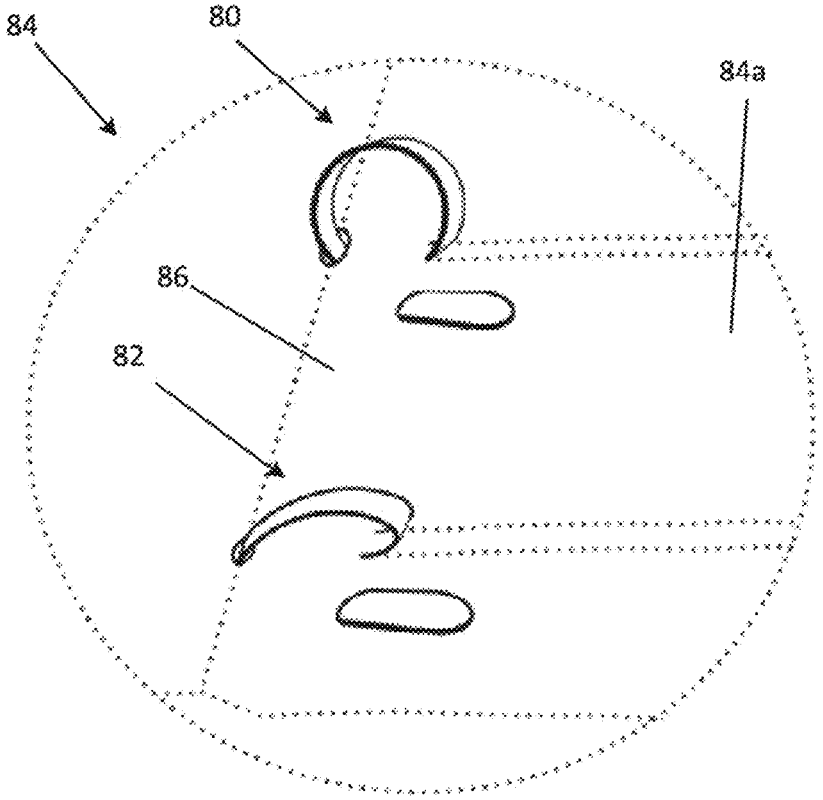
FIG. 2A is an isometric partial view of a binding device formed as part of a portfolio, in accordance with embodiments of the present solution.

In some cases, however, it may be appropriate to use structures other than spines to connect multiple binding devices. For example, FIG. 2*a* shows two binding devices 80 and 82 that are implemented as an integral part of a portfolio 84. In the illustrated embodiment, the binding devices 80 and 82 are substantially similar to the binding device 30 shown in FIG. 2. In this regard, for example, the ties of the binding devices 80, 82 are formed from a common flexible sheet 86 that also includes openings for ties of the binding devices 80, 82, and forms front and rear covers for the bound material (not shown). In particular, the ties can be cut from a portion of the flexible sheet 86 that forms a rear or a front (or other) cover 84*a* of the portfolio 84.

Although binding devices with two holes per tie are generally shown in the examples of FIGS. 1 through 4B, other embodiments can exhibit a different number of holes for any given tie. For example, some embodiments of the present solution may be configured to include more than two openings. In some cases, additional openings can provide additional points of engagement for a tie, as may help to increase the binding capacity of a particular binding device. In some cases, additional openings can also allow for additional bends (e.g., acute bends) in a tie when a binding device is in a fully coupled state. This can also help to increase the binding capacity of a particular binding device, including by increasing resistance to withdrawal of a tie out of the relevant openings. In some cases, this increased resistance can allow binding devices of a given material and material thickness to bind a larger amount of target material than may be possible with fewer openings.

As also noted above, in some embodiments with more than two openings, a tie can be secured with multiple bends, including an obtuse bend and one or more acute bends. For example, the openings may be arranged such that a tie that extends in one direction before passing through a first opening must bend at an acute angle (e.g., as measured in direction parallel to the plane of the flexible sheet) after passing through the first opening to extend in a different direction to a second opening. In some embodiments, after passing through the second opening, the tie may again extend in a different direction to extend to a third opening. In some embodiments, this second change in direction may force the tie to bend at another acute angle (e.g., also as measured in a direction parallel the plane of the flexible sheet), although other configurations are possible. As also noted above, the use of multiple acute bends in this fashion can sometimes provide substantial binding strength.

In some embodiments, more than three openings can be provided. In some embodiments, for example, after passing through a third opening, a tie may again change directions to extend towards a fourth opening. In some embodiments, a tie may be bent at an acute angle at alternating, rather than successive openings. In some embodiments, a tie may pass through a first sequential opening without an acute bend, then pass through successive (e.g., third and fourth) sequential openings with acute bends.

Figure 5:
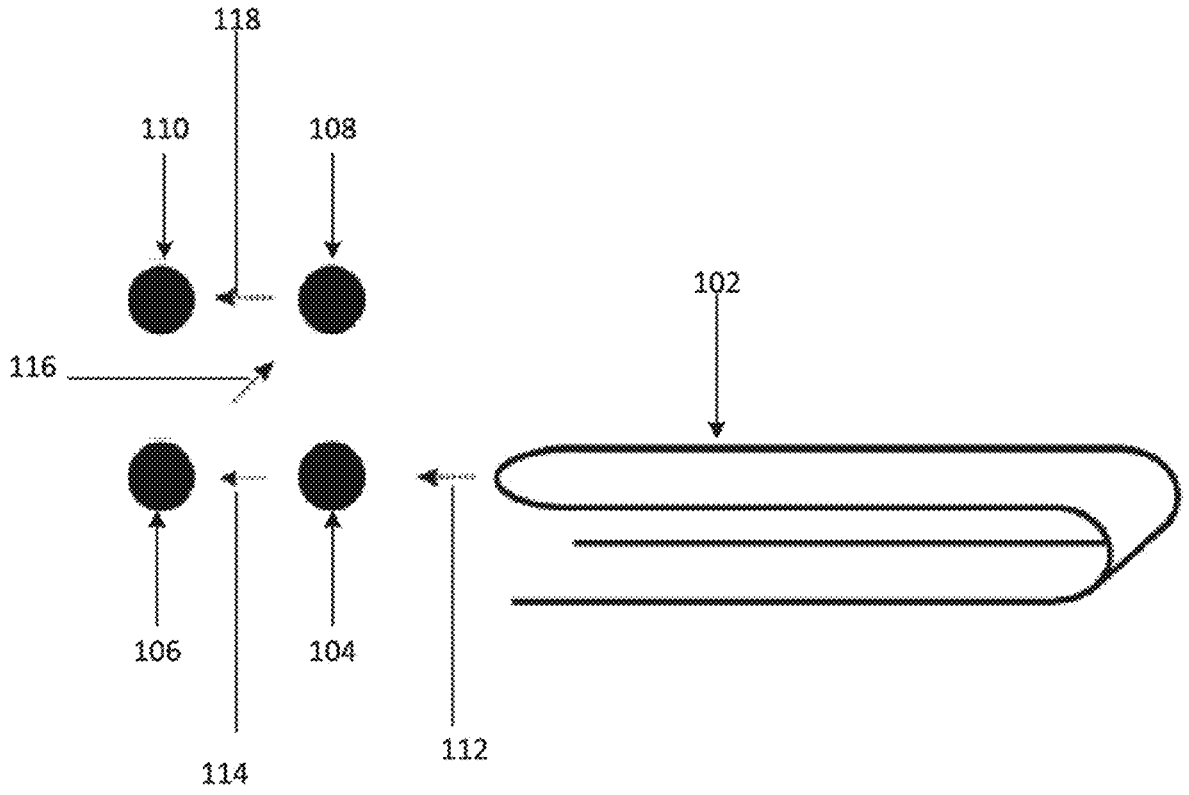
FIG. 5 shows a schematic view of a binding device in accordance with an embodiment of the present solution in a fully uncoupled state.

FIG. 5 shows an example binding device according to an embodiment of the present solution, with a tie 102 and four openings: a first opening 104, a second opening 106, and third opening 108, and a fourth opening 110. FIG. 8 also shows, schematically, a series of operations by which the tie 102 can couple with the openings, such as may allow the tie 102 to bind target material (not shown). In the illustrated example, the tie 102 initially extends in a direction 112 towards the first opening 104. The tie 102 then passes through first opening 104 and extends in a different direction 114, substantially parallel to and aligned with the direction 112, towards the second opening 106. The tie 102 then passes through second opening 106 and bends at an acute angle to extend in a direction 116 towards the third opening 108. Similarly, after passing through the third opening 108, the tie 102 bends at another acute angle to extend in a direction 118 towards fourth opening 110. The tie 102 then passes through fourth opening 110 to place the binding device in a fully coupled state.

When coupled with the operations illustrated in FIG. 5, the tie 102 accordingly forms multiple bends at acute angles (e.g., as measured substantially within the plane of the relevant, flexible sheet) at the two openings 106, 108. Accordingly, the tie 102—and the binding device generally—may exhibit substantial binding strength. And, in some cases, binding strength can be further improved extension of the tie 102 through the openings 104, 110, even with parallel extension of the tie 102 before and after the openings 104, 110. For example, the extension of the tie 102 through the opening 104 can help to ensure appropriate and continue alignment of the tie 102 with the opening 106 and thereby help to ensure that the acute bend at the opening 106 is maintained. Further, extension of the tie 102 through the opening 110 can similarly contribute to the appropriate alignment of the tie 102 relative to the acute bend at the opening 108, while also helping to reduce the susceptibility of the loose, free end of the tie 102 to damage, slippage, or other adverse consequences.

In some embodiments, further acute bends can be provided. For example, in some embodiments, the tie 102 can be configured to form additional bends (not shown), such as by arranging the tie 102 to extend in a different direction before entry into the opening 104 or after passage through the opening 110.

In some embodiments of the present solution, the openings of a binding device can be arranged in a variety of shapes, beyond the substantially square arrangement shown in FIG. 5 In some embodiments of the present solution, the distances between the openings can vary, including based on factors such as the material from which the flexible sheet is formed, the length of the tie, and the purpose for which the binding device is used. In some embodiments of the present solution, a tie could travel in a unique direction before or after passing through each opening relative to the directions that tie travels before or after passing through each other opening. In some embodiments of the present solution, some of the directions that a tie travels before or after passing through openings may be repeated before or after the tie passes through a different opening.

As also noted above, different embodiments can include more or fewer openings than the examples illustrated in the various Figs. For example, some embodiments of the present solution can include more than four openings, depending on the size of the openings, the size of the flexible sheet, the material properties of the flexible sheet, and the intended purpose.

In some embodiments, it may be possible for a binding device to be used in a partially coupled state, such as a state in which a tie has passed through some, but not all, of the relevant openings of the binding device. For example, in a four-opening embodiment, an adequate binding capacity may sometimes be obtained after a tie has passed through openings that are sufficient for the tie to form a single bend at an acute angle, even if certain openings associated with the tie have not yet been engaged (i.e., with the binding device in a partially coupled state). It may be beneficial for a binding device to be able to bind target material when only in a partially bound state, for example, as users may be able to save time by only having to thread the tie through some of the openings (e.g., if the amount of target material being bound is sufficiently limited). This customizability of coupled states can also allow some embodiments of the present solution to produce a range of binding strengths, based on the number and selection of openings through which a user threads a particular tie.

Figure 6:
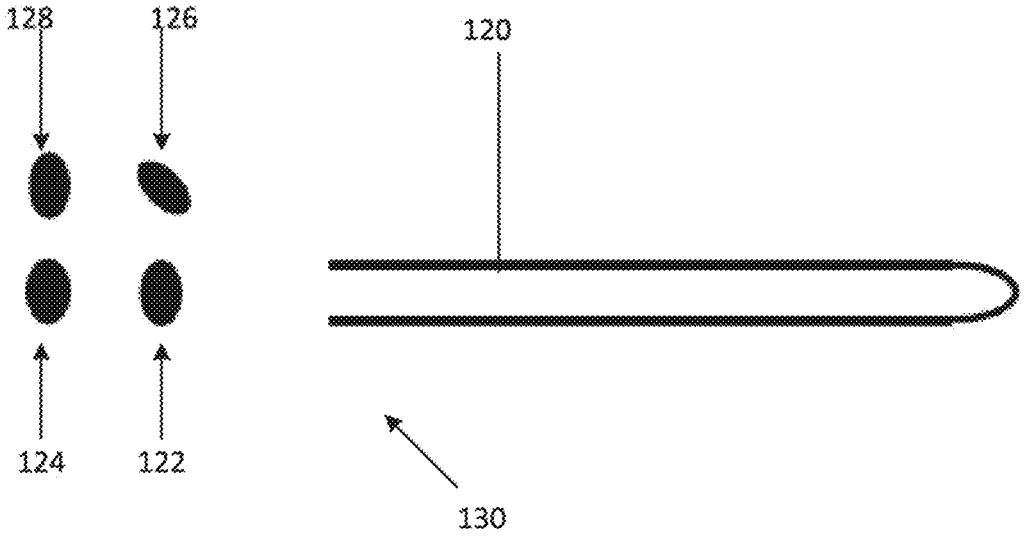
FIGS. 6 and 7 show schematic views of a binding device in accordance with an embodiment of the present solution, in a fully uncoupled state and a fully coupled state, respectively.

In different embodiments, including embodiments with four or fewer openings, differently configured openings can be used. For example, FIG. 6 shows a schematic view of an example binding device 130 that is similar to the binding device shown in FIG. 5, except that the openings 122, 124, 126, 128 for a tie 120 that are substantially ovular in shape (e.g., rather than substantially circular). Further, the opening 126 is oriented differently from the other openings 122, 124, and 128, with a major axis of the opening 126 acutely angled relative to major axes of the openings 122, 124, 128. In some embodiments of the present solution, varying the orientation of some openings relative to others may more readily cause a tie to twist or bend as the tie passes through the varied-orientation opening(s) or otherwise increase the engagement force between the tie and the edges of those openings. In some cases, these effects can generally increase the amount of resistance that opposes the withdrawal of the tie, which may correspondingly provide, allow the relevant devices to bind a greater amount of target material.

The tie 120 to secure material, can generally be coupled similarly to the tie 102 of FIG. 5. For example, as illustrated in FIG. 6, the tie 120 of binding device 130 extends along the front side of the relevant, flexible sheet (e.g., a portfolio or spine), passes through the first opening 122, travels along the backside of the flexible sheet, passes through the second opening 124, travels along the front side of the flexible sheet towards the third opening 126, and then passes through third opening 126. Notably, the tie 120 bends at an acute angle at the second opening 124 (e.g., as measured in the plane of the flexible sheet), with an angular degree that is defined by the openings 122, 124, and 126, and also at third opening 126, with an angular degree that is defined by openings 124, 126, and 128. After the second acute bent, the tie 120 then extends along the backside of the flexible sheet towards the fourth opening 128, before passing through fourth opening 128 so that a free end of the tie 120 is appropriately secured. With the tie 120 arranged, target material (not shown) engaged with a loop 120*a* of the tie 120 can be strongly secured.

Figure 7:
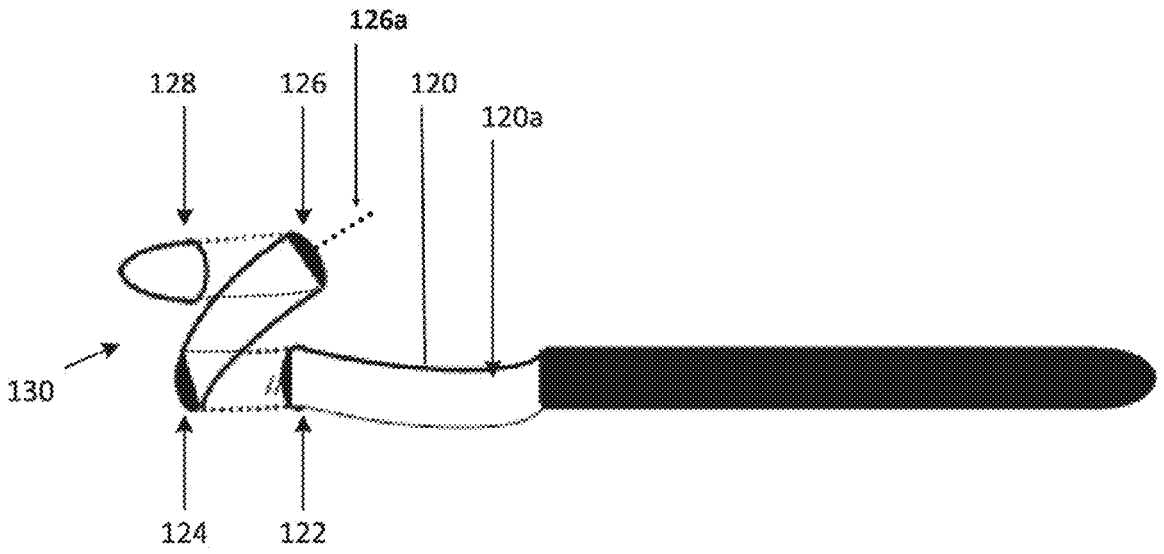

In some embodiments, a side cut can be provided in order to allow access to the inner area of a particular opening. For example, as shown with a dashed line in FIG. 7, a side cut 126*a* can be formed through the relevant substrate to allow access to the inner area of the opening 126. In some embodiments, such a side cut can extend fully to the edge of the substrate, although other configurations are possible. Further, in some embodiments, multiple openings (e.g., a plurality of the openings 122, 124, 126, 128) can have an associated side cut. In some embodiments, side cuts may extend between two or more openings.

In some embodiments, openings to engage a tie can be formed on flaps that can be folded somewhat away from an associated flexible sheet. In some cases, this may help to improve the ease with which users can secure a tie in a coupled state. For example, some embodiments with flaps can be secured in a coupled state with a tie remaining substantially on only one side of a relevant, flexible sheet, other than at edges of certain flaps. Accordingly, it may be possible for a user to place the relevant binding device in a coupled state without the need to engage a tie from two different sides of a flexible sheet. It may be particularly useful, for example, for binding devices implemented as part of portfolios or in other arrangements that are configured to bind large amounts of material.

Figure 8A:
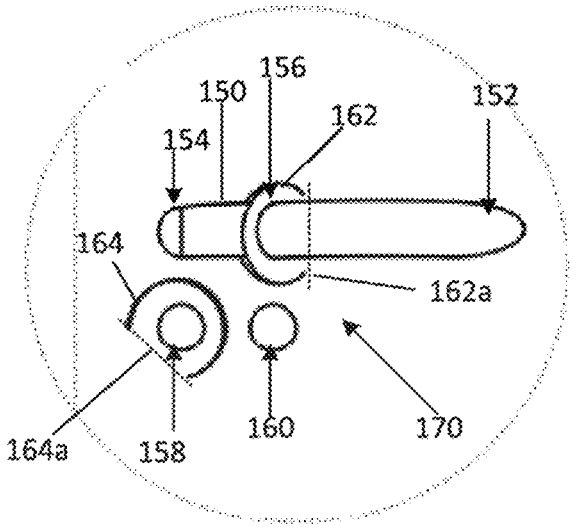
FIGS. 8A through 8C show aspects of operations to secure material using a binding device according to an embodiment of the present solution.
Figure 8B:
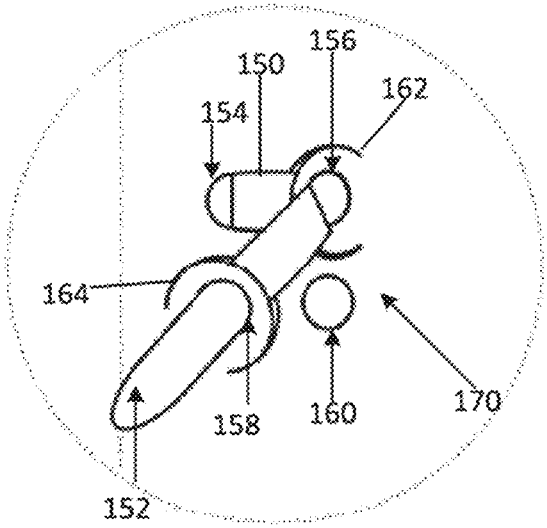
Figure 8C:
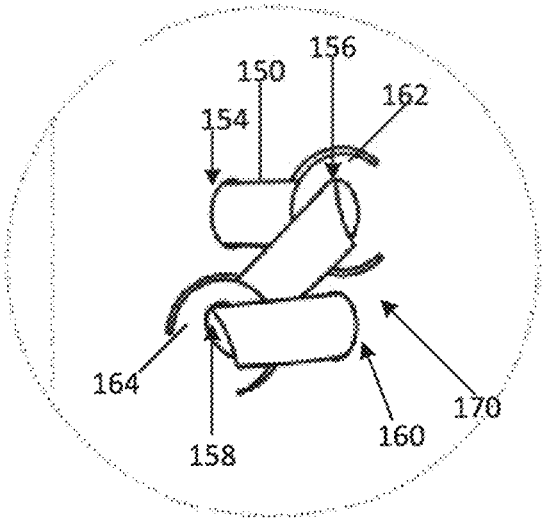

As one example, FIGS. 8A through 8C show a series of operations by which another example binding device 170 can be placed in a coupled state. In the illustrated example, the binding device 170 includes a tie 150 with a leading end 152, a first opening 154, a second opening 156, a third opening 158, and a fourth opening 160. Further, the second opening 156 is disposed on and partially surrounded by a flap 162, and the third opening 158 is disposed on and partially surrounded by a flap 164. The flaps 162 and 164 are formed from and cut out of the same flexible sheet (e.g., a portfolio cover) from which the openings 154, 156, 158, and 160 and the tie 150 are cut.

FIG. 8A shows the binding 170 in a partially coupled state after the tie 150 has been passed from a back (or other) side of the flexible sheet through first opening 154, extended along the front (or other) side of the flexible sheet towards second opening 156, and passed through second opening 156. Because second opening 156 is disposed on flap 162, the tie 150 remains substantially on the front side of the flexible sheet as it passes through second opening 156, only extending behind a small amount of the flexible sheet that forms a part of the border of the second opening 156 on flap 162.

Continuing, FIG. 8B shows the binding 170 in a more substantially coupled state, after the tie 150 has been extended along the front side of the flexible sheet and passed through the third opening 160. Again, because the third opening 158 is disposed on the flap 164, the tie 150 remains substantially on the front side of the flexible sheet as it passes through third opening 158, only extending behind the small amount of flexible sheet that forms a part of the border of the third opening 158 on the flap 164. Notably, the tie 150 exhibits an acute bend at the second opening 156 as may help to secure the tie 150 against withdrawal and thereby help to bind target material (not shown) that may be engaged by a loop of the tie 150.

Finally, FIG. 8C shows the binding 170 in a fully coupled state after the tie 150 has been extended again along the front side of the flexible sheet and then passed through the fourth opening 160. Notably, the tie 150 exhibits another acute bend at the third opening 158, as may help to further secure the tie 150 against unwanted withdrawal. Further, because of the arrangement of the openings 156, 158 on the flaps 162, 164, the tie 150 has remained substantially on the front side of the flexible sheet throughout the bulk of the coupling operations. As also noted above, this may allow a user to relatively easily couple the tie 150, from a single side of the flexible sheet. As with other embodiments, the leading end 152 of the tie 150 (not shown in FIG. 8C) can then be tucked through the fourth opening 160, to be finally secured on the backside of the flexible sheet, after having passed through fourth opening 160.

In some embodiments, flaps of a binding device can be formed with different orientations relative to each other. For example, as shown in FIGS. 8A-8C, the flap 162 is formed to exhibit a substantially vertical fold line 162*a* (relative to the illustrated orientation) relative to the adjacent flexible sheet, and the flap 164 is formed to exhibit a fold line 164*a* that is acutely angled relative to the fold line 162*a*. This may be useful, for example, to dispose of the flaps 162, 164 to be relatively easily opened, away from the incoming direction of the tie 150, to receive the tie 150 through the relevant openings 156, 158. In other embodiments, other configurations are possible, including configurations with flaps that exhibit non-acutely angled fold lines relative to each other.

As also discussed above, in some embodiments, having at least some openings disposed on flaps may provide benefits. In some embodiments, having the tie remain substantially on one side of the flexible sheet as it passes through and travels between many of the openings may provide an aesthetic benefit. For example, having a tie remains substantially on the backside of a flexible sheet that may allow it to be hidden from view, which can provide a cleaner or less complicated look that may be desirable. In some embodiments, having a tie remain substantially on one side of a flexible sheet may make it easier for some users to thread the tie through the openings because the tie will not have to travel along both sides of the flexible sheet, so the user may not need to access both sides of the flexible sheet. In some embodiments of the present solution, having a tie remains substantially all on one side of a flexible sheet may make it easier for some users to thread the tie through the openings because a user may be better able to see the tie as he passes it through the openings.

Figure 9:
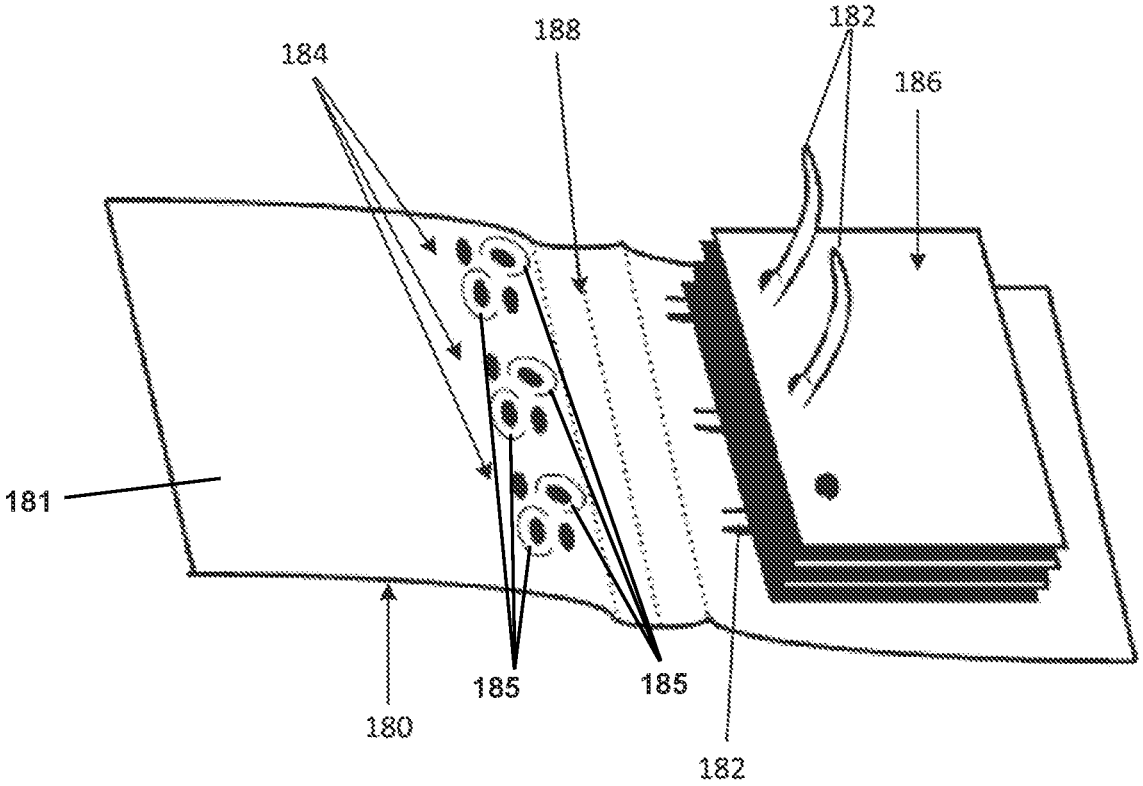
FIGS. 9 through 12 show isometric views of multiple binding devices implemented in portfolios in accordance with embodiments of the present solution.
Figure 12:
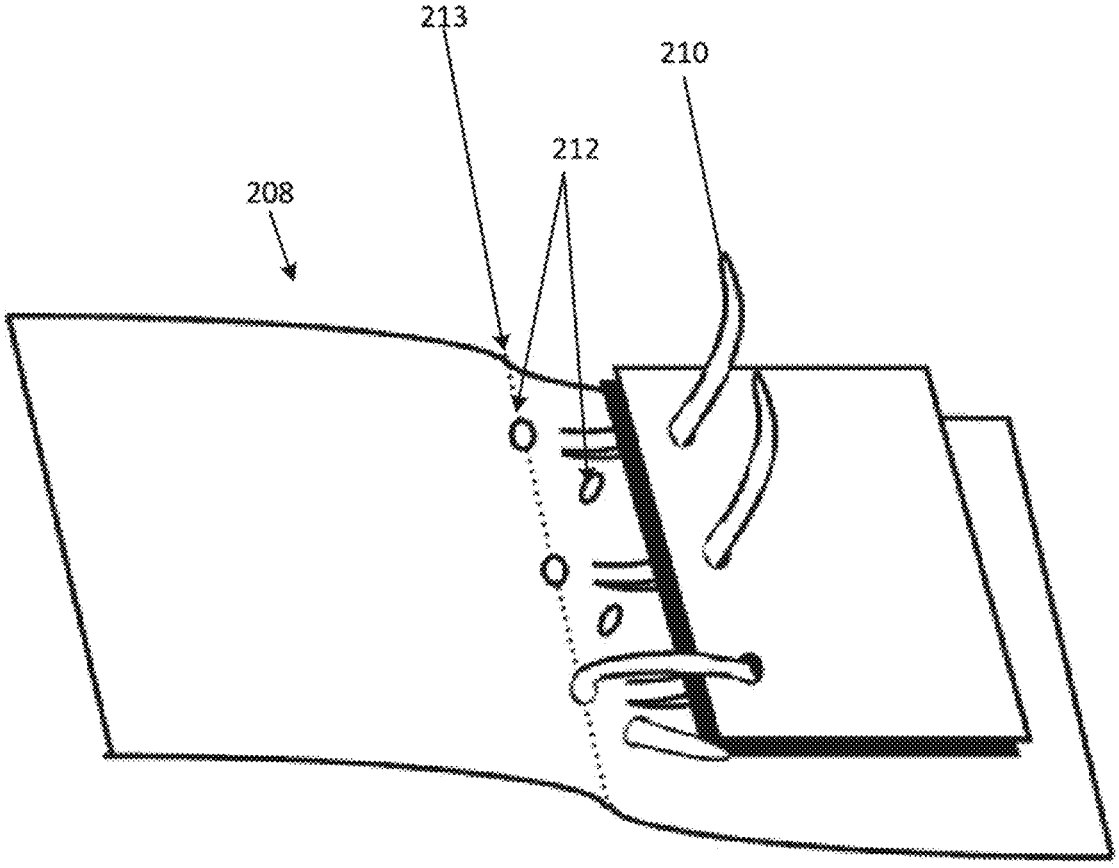

FIG. 9 shows an embodiment of the present solution that is similar to the embodiment of FIG. 12, but in which multiple binding devices are implemented in a portfolio 180 rather than as part of a stand-alone spine. The binding devices of FIG. 9 include a set of four openings 184 and a tie 182. (The tie 182 of one binding device is only partly shown, as it is still being threaded through the target material 186.) As shown in FIG. 9, some of the openings 184 are provided on flaps 185 arranged for use similar to the flaps 162, 164 of FIGS. 8A-8C, while some of the openings 184 are provided in a flexible sheet 181 of the portfolio 180.

In the illustrated embodiment, the portfolio 180 also includes a spine 188, with the openings 184 of each binding device disposed on an opposite side of the spine 188 from the associated tie 182. As also discussed above, for example, this may help to allow the portfolio 180 to conveniently accommodate a wider range of target material 186 than might otherwise be possible. In this regard, for example, not only can the spine 188 expand to accommodate a large amount of bound material, but the spine 188 can also compress to reduce the overall profile of the portfolio 180 when a smaller amount of bound material is engaged.

Figure 10:
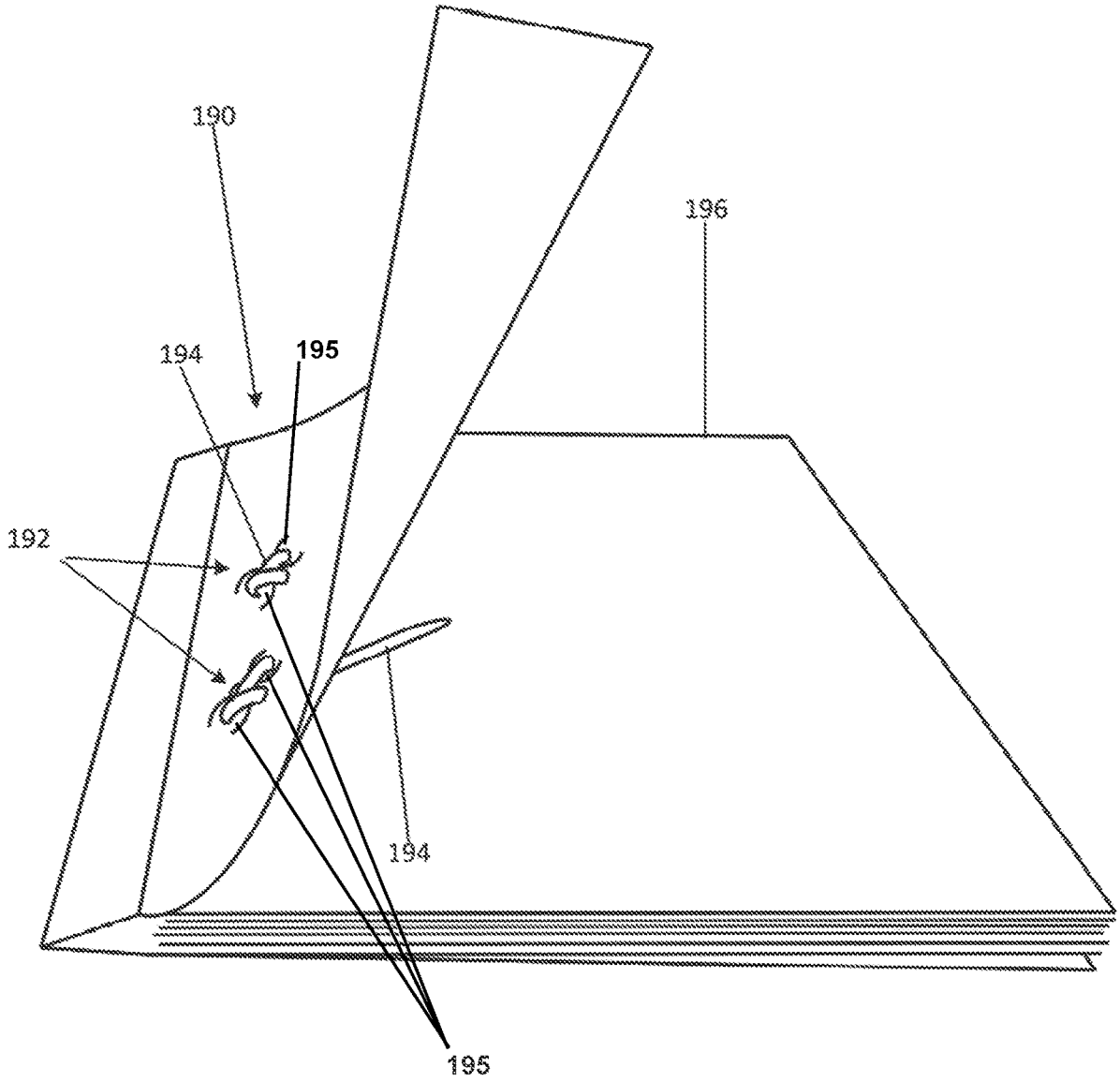

FIG. 10 shows a portfolio 190 similar to the portfolio 180, according to an embodiment of the present solution. In particular, the portfolio 190 includes multiple binding devices 192 with ties 194 and associated openings and flaps (e.g., flaps 195 with cut edges as shown in FIG. 10, arranged similarly and for similar use as the flaps 162, 164 of FIGS. 8A-8C); each formed integrally (i.e., monolithically) with the material of the covers of the portfolios 190. With the binding devices 192 in a fully coupled state to secure bound material 196, as shown, the ties 194, the leading ends of the ties 194 are positioned with the cover of the portfolio 190. As such, the leading end of the tie 194 would not be visible from the outside of the portfolio, as may provide aesthetic benefits to the portfolio. Further, for similar reasons, the leading end of the tie 194 can be prevented from becoming tangled, caught, or damaged during the use and transportation of the portfolio.

Generally, portfolio 190 provides an example of an embodiment that has a low profile. For example, due to the relative thin aspect and parallel orientation of the ties 194 relative to the portfolio covers, neither side of the portfolio 190 or the tie 194 extends beyond the dimensions of the target material 196 by substantially more than its thickness. Notably, some embodiments of the present solution can provide a low profile substantially similar to the portfolio 190 regardless of how much (or how little) target material is bound.

As also alluded to above, some embodiments of the present solution may be configured to have openings disposed on either side of a spine of a portfolio or a stand-alone (or other) spine. For example, some embodiments may have all of the relevant openings disposed on the side of a spine to which an associated tie is anchored. As another example, some embodiments may have all of the relevant openings disposed on the side of the spine that is opposite of where an associated tie is anchored. Some embodiments may have some openings disposed on both sides of the spine or on the spine itself.

Figure 11:
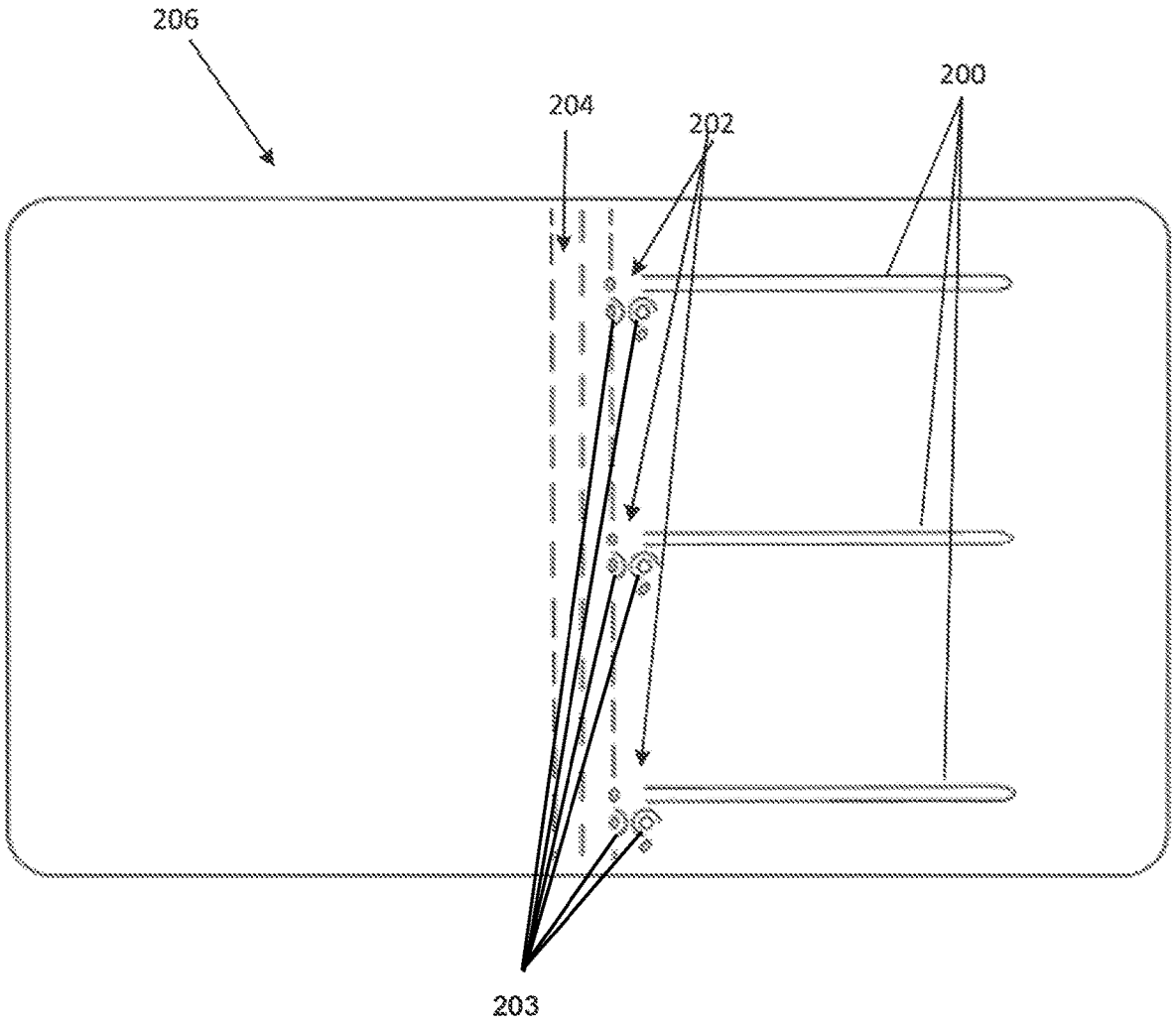

In this regard, for example, FIG. 11 shows an embodiment of the present solution configured as a portfolio 206. In the embodiment shown, openings 202, flaps 203, and ties 200 of each of three binding devices are disposed on the same side of a spine 204 of the portfolio 206. This arrangement may provide numerous benefits, including aesthetic benefits such as keeping one side of the portfolio 206 complete free from openings, flaps, and ties, and other functional benefits.

As another example, FIG. 12 shows an embodiment of the present solution configured as a portfolio 208. In the embodiment shown, at least some of the openings 212 (e.g., second openings) of each of three binding devices are disposed on a spine 213 of the portfolio 208. This arrangement may provide numerous benefits, including allowing relatively large amounts of space between openings while keeping one side of the portfolio 208 free from openings or ties. This may have both functional and aesthetic value.

Figure 13:
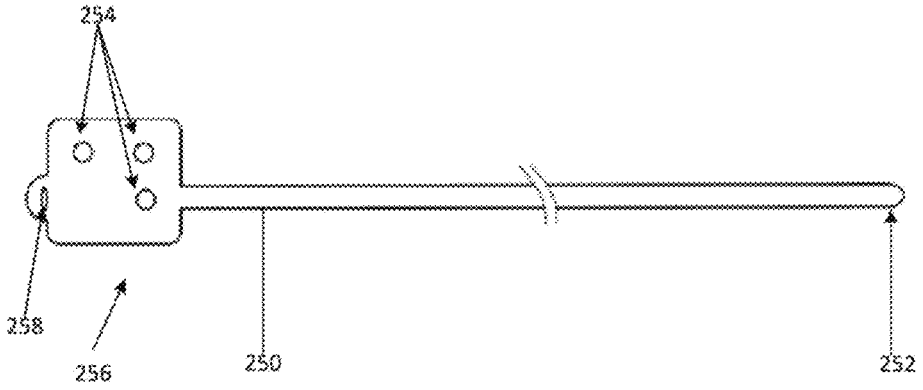
FIGS. 13 through 18 show embodiments of the present solution configured for use as stand-alone binding devices.

FIG. 13. In some embodiments, stand-alone binding devices can include additional openings to help to form a tie into a loop appropriately and align the tie to be secured with acute bends, as also discussed above. For example, the binding device 256 includes an opening formed as an eyelet 258 through which the leading end 252 of the tie 250 may pass. In this embodiment, the eyelet 258 is disposed of on a protrusion of the flexible sheet and is substantially ovular in shape, although other configurations are possible. For example, in some embodiments, an eyelet may be configured in other shapes, or maybe disposed on other parts of a flexible sheet (e.g., not on a protrusion thereof). Some stand-alone embodiments of the present solution may not comprise an eyelet.

As alluded to above, passing the tie 250 through the eyelet 258 may allow the tie 250 to be readily formed into a loop before the tie 250 passes through the openings 254 to fully couple the binding device 256 around the relevant target material. In some embodiments, this may allow the user to easily adjust the size of the loop formed by the tie 250, which may be beneficial for sizing or tightening the loop around target material even before the binding device 256 is fully coupled.

Figure 14:
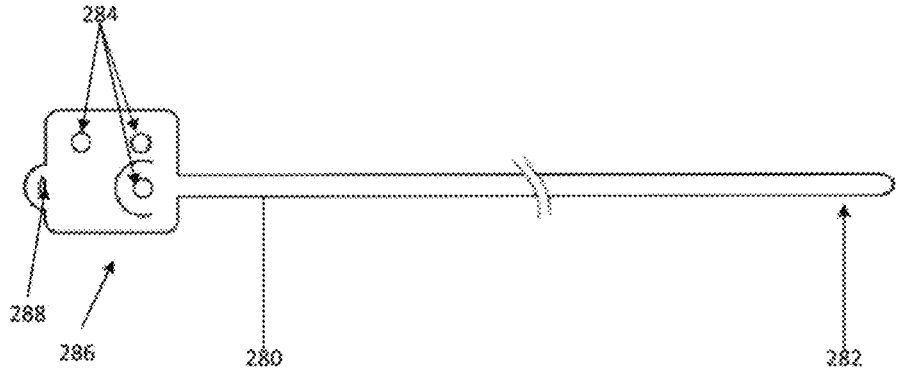

FIG. 14 shows another stand-alone embodiment, configured as a binding device 286. The binding device 286 is substantially similar to the binding device 256 shown in FIG. 13, except that one of the openings 284 of binding device 286 is disposed on a flap of the flexible sheet. As similarly described above, this arrangement can improve the ease with which a user can fully couple the binding device 286 and can allow the tie 280 to remain substantially on one side of the flexible sheet as the leading end 282 of the tie 280 passes through the opening 284 that is disposed on the flap. In comparison, for example, the tie 280 would alternate on which one side of the flexible sheet it extends along as the leading end 282 of the tie 280 passes through the openings 284 that are not disposed on a flap.

Figure 15:
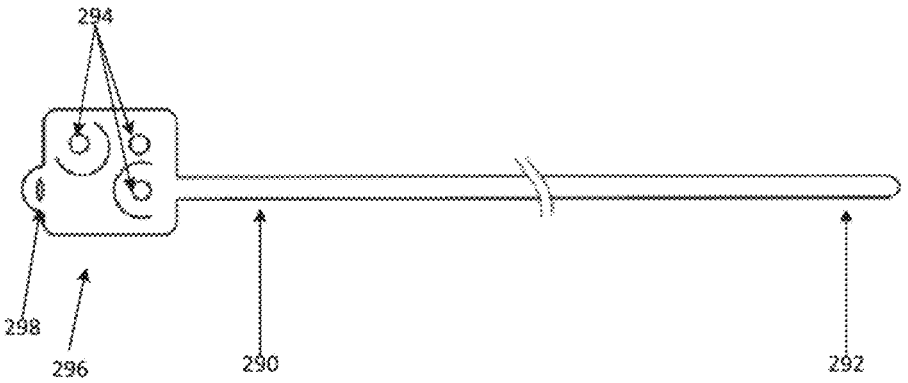

FIG. 15 shows another stand-alone embodiment of the present solution, configured as a binding device 296. The binding device 296 is substantially similar to the binding devices 256, 286, shown in FIGS. 18 and 19, except that two of the openings 294 of binding device 296 are disposed on flaps of the flexible sheet. Similar to other openings that are disposed on flaps of a flexible sheet (e.g., as described above), this arrangement can improve the ease of coupling the binding device 286 and also allow the tie 290 to remain substantially on one side of the flexible sheet as the leading end 292 of the tie 290 passes through the openings 294 that are disposed on the flaps. In comparison, for example, the tie 290 would alternate which side of the flexible sheet it extends along as the leading end 292 of the tie 290 passes through the opening 294 that is not disposed on a flap.

Figure 16:
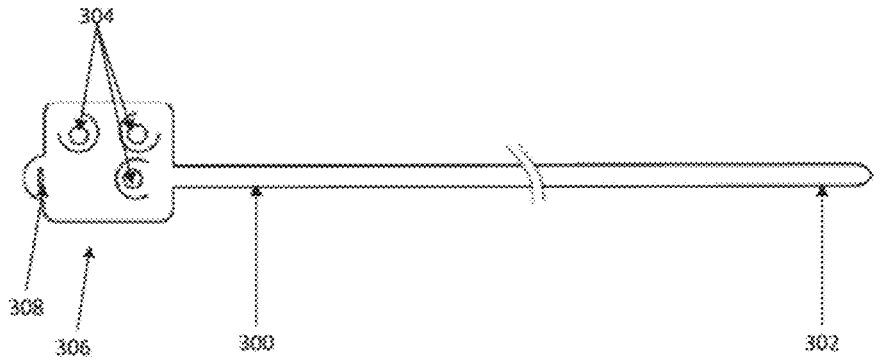

FIG. 16 shows another stand-alone embodiment of the present solution, configured as a binding device 306. The binding device 306 is substantially similar to the binding device 256, 286, 296, shown in FIGS. 18-20, except that all of the openings 304 of binding device 306 are disposed of on flaps of the flexible sheet. As similarly described above, this arrangement can improve the ease of coupling the binding device 306 and can also allow the tie 300 to remain substantially on one side of the flexible sheet as the leading end 302 of the tie 300 passes through the openings 304.

Figure 17:
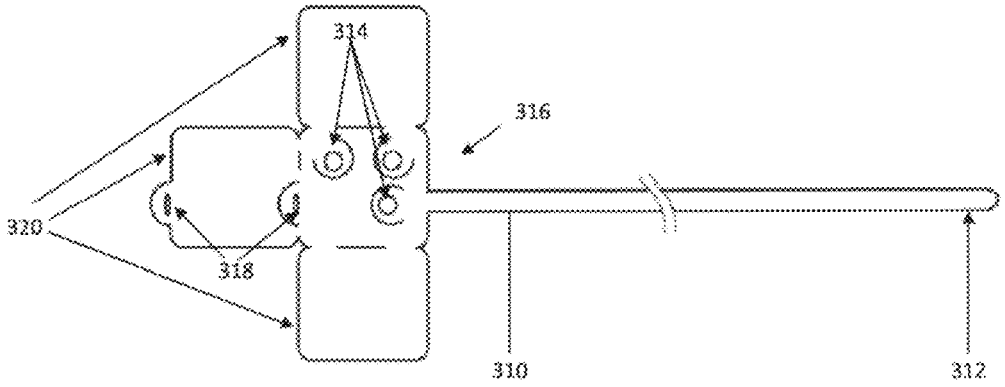

FIG. 17 shows another stand-alone embodiment of the present solution, configured as a binding device 316. The binding device 316 is substantially similar to the binding device 306 that is shown in FIG. 21, but further includes leafs 320 of the flexible sheet, and an additional eyelet 318 that is disposed on a protrusion from one of the additional leafs 320. In some configurations, the additional leafs 320 can be folded behind the primary portion of the flexible sheet to which the tie 310 is anchored and from which the openings 314 are cut. This may be useful, for example, to provide increased strength to the binding device 316 overall, as well as to reduce the flexibility of the primary portion of the flexible sheet to help resist deformation when the tie 310 is fully coupled to bind target material (not shown).

In the embodiment shown in FIG. 17, the additional leafs 320 are arranged such that one leaf is disposed on each side of the primary portion of the flexible sheet, except for the side to which the tie 310 is anchored. In some embodiments, the additional leafs 320 can be arranged in series (e.g., linearly), such that only the leaf nearest the primary portion of the flexible sheet is linked directly to the primary portion of the flexible sheet and the further additional leafs of flexible sheet are each linked to each other in a series arrangement that travels away from the primary portion of the flexible sheet. In some embodiments of the present solution, there may be more than three additional leaves of the flexible sheet. In some embodiments, there may be fewer than three additional leaves of the flexible sheet.

Figure 18:
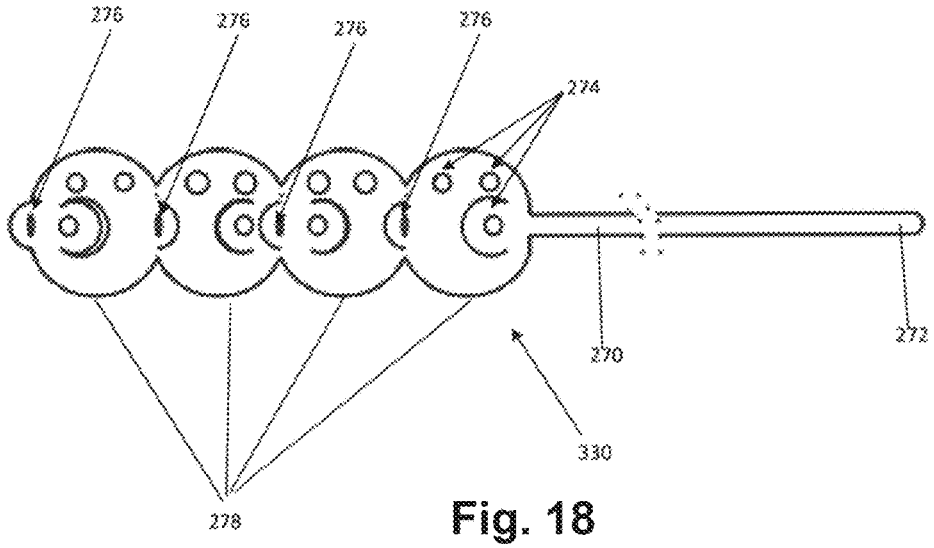

FIG. 18 shows another stand-alone embodiment of the present solution, in which a binding device 330 includes multiple openings 274, a tie 270 with a leading end 272, multiple additional leafs 278, and multiple openings configured as eyelets 276. The additional leafs 278 of the flexible sheet are arranged linearly in the embodiment shown, although other configurations are possible. Notably, each of the additional leafs 278 includes openings that align with the openings 274 on the primary portion of the flexible sheet when the additional leafs 278 are folded. Also, as shown in FIG. 18, certain openings on each additional leaf 278 are disposed on flaps that align with one of the openings 274 on the primary portion of the flexible sheet that is disposed on a flap when the additional leaves are folded. Thus, for example, the tie 270 can extend through multiple aligned openings, including the openings on the flaps, in an arrangement similar to that discussed above (see, e.g., FIG. 19C), but with enhanced strength due to the multiple layers of flexible sheet. Likewise, when the leafs 278 are folded, overlapping sets of the eyelets 276 are configured to be disposed on one or opposing sides of the primary portion of when the additional leaves are properly folded.

FIGS. 19A-19C show a series of operations by which an example stand-alone binding device 350, can be placed in a coupled state. The binding device 350 is generally similar to the binding device 330 of FIG. 19A, with openings 354 formed on flaps in a primary portion 356 of the flexible sheet, an eyelet 358 on the primary portion 356, a tie 352 that is anchored to the primary portion 356, and multiple additional leafs 360*a-c* of flexible sheet that arranged linearly in series with the primary portion 356. Also as with the binding device 330, each of the additional leafs 360 further includes openings 362 formed on flaps, and openings configured as eyelets 364, each of which aligns with a corresponding one of the openings 354 and an eyelet 358 that have been formed (e.g., cut, punched, etc.) in the primary portion 356 of the flexible sheet.

FIGS. 19A and 19B show the binding device 350 in a partially coupled state, with the leafs 360*a-c* partially folded (e.g., in a partial accordion fold) so that the eyelets 364 and the openings 362 on the additional leafs 360 are generally aligned with each other and with corresponding sets of the openings 354, the eyelet 358, and the tie 352. Further, the tie 352 has been passed through the eyelets 364 on two of the leafs 360—the leaf 360*a* adjacent to the primary portion and the leaf 360*c* opposite the primary portion of the flexible sheet—so as to guide further accordion folding of the leafs 360*a-c* and the primary portion 356 and to dispose the tie 352 to form a loop to secure target material.

With further folding, the leafs 360*a-c* and the primary portion 356 can be disposed as shown in FIG. 19C, so that the openings 354 and associated flaps are aligned with the openings 362 and associated flaps (see FIG. 19A), and the tie 352 extends through all of the eyelets 358, 364 to form a loop 352*a*. With target material (not shown) appropriately secured in the loop 352*a*, the tie 352 can then be secured in a coupled state via the formation of oblique bends at the various openings 354, 362 (e.g., as described variously above). In this way, for example, a strong and flexible binding can be established for any variety of target material. Further, due to the overlapping reinforcement of the primary portion 356 and the leafs 360*a-c* and the inherent strength of the acute-bend engagement of the tie 352, a secure binding can be achieved even when the binding device 350 is formed from relatively flexible, inexpensive material.

Figure 20A:
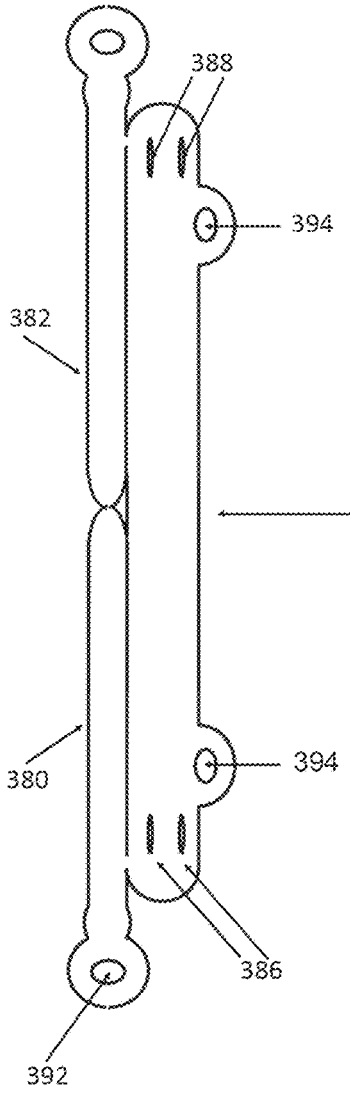
FIGS. 20A through 21B show embodiments of the present solution formed as part of a portfolio, with separable ties.
Figure 20B:
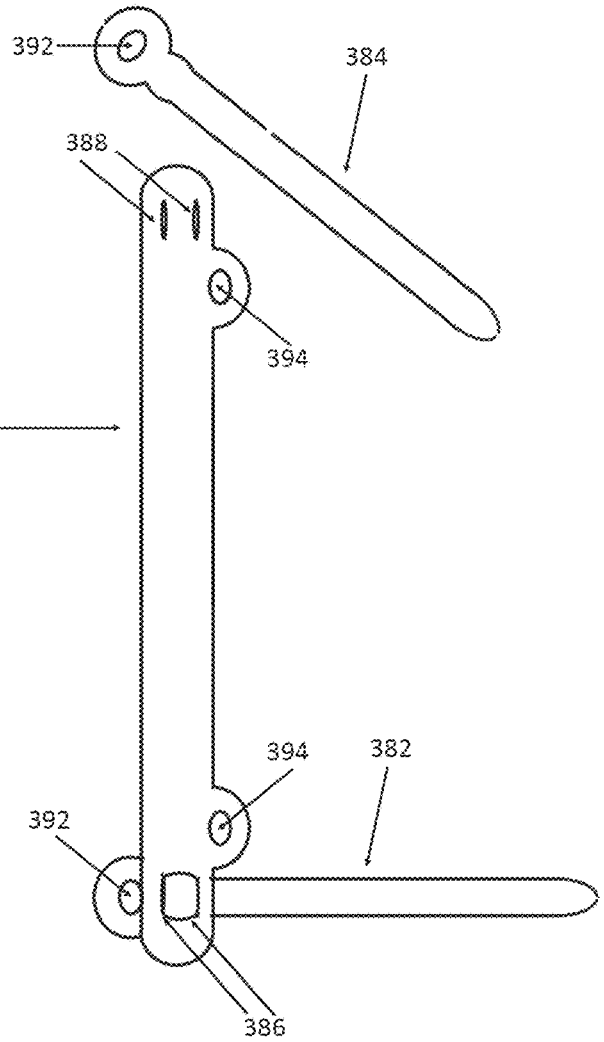

FIGS. 20A and 20B show another embodiment of the present invention. The specific embodiment shown in FIGS. 20A and 20B has a binding spine 380 and ties 382 and 384. The binging spine comprises two set of cuts 386 and 388 as well as openings 394. Some alternative embodiments may comprise only one set of cut and only one opening, although they may although other alternative embodiments may comprise more than two sets of cuts and more than two openings. The binding spine and ties may be cut from the same sheet of material or may be formed from different materials. Both the spine and the ties may be formed from any of the materials discussed above or other similar materials. The spine and the ties may be cut from a single sheet of material such that there is some uncut or shared material between them, so that the spine and ties are physically linked together by this shared material. This shared material may be thin enough that it can easily be torn by a user, so that the ties and spine can easily be separated from each other for use.

FIG. 20B shows an embodiment of the present invention that is substantially similar to the embodiment of FIG. 20A, however, FIG. 20B shows the embodiment after the ties 382 and 382 have been separated from the spine and from each other. Furthermore, shows tie 382 in a state after it has travelled through the set of cuts 386. At this point tie 382 could travel through a hole punched into target paper or surround other target material before travelling back towards opening 392 and passing through it, and then passing through the opening 394. This path would cause tie 382 to bend at an acute angle as well as to engage the inner sides of opening 392, which would hold tie 382 in place and bind the target material for the reasons discussed above. FIG. 20B shows tie 384 in a state before it has passed through any cuts or openings, but it could pass through cut 388 and opening 394 in a manner similar to that discussed from tie 382. Some alternative embodiments could have more cuts or more openings disposed on their binding spine, which could provide increase binding strength. In some embodiments the location of the cuts relative to the location of the associated opening(s) could vary from that for FIGS. 20A and 20B by being disposed further apart from each other and/or having at least some of the cuts be disposed further away from the top and bottom ends of the binding spine than their associated openings are. These alternative configurations may provide benefits in some situations, including potentially increased binding strength.

Figure 21A:
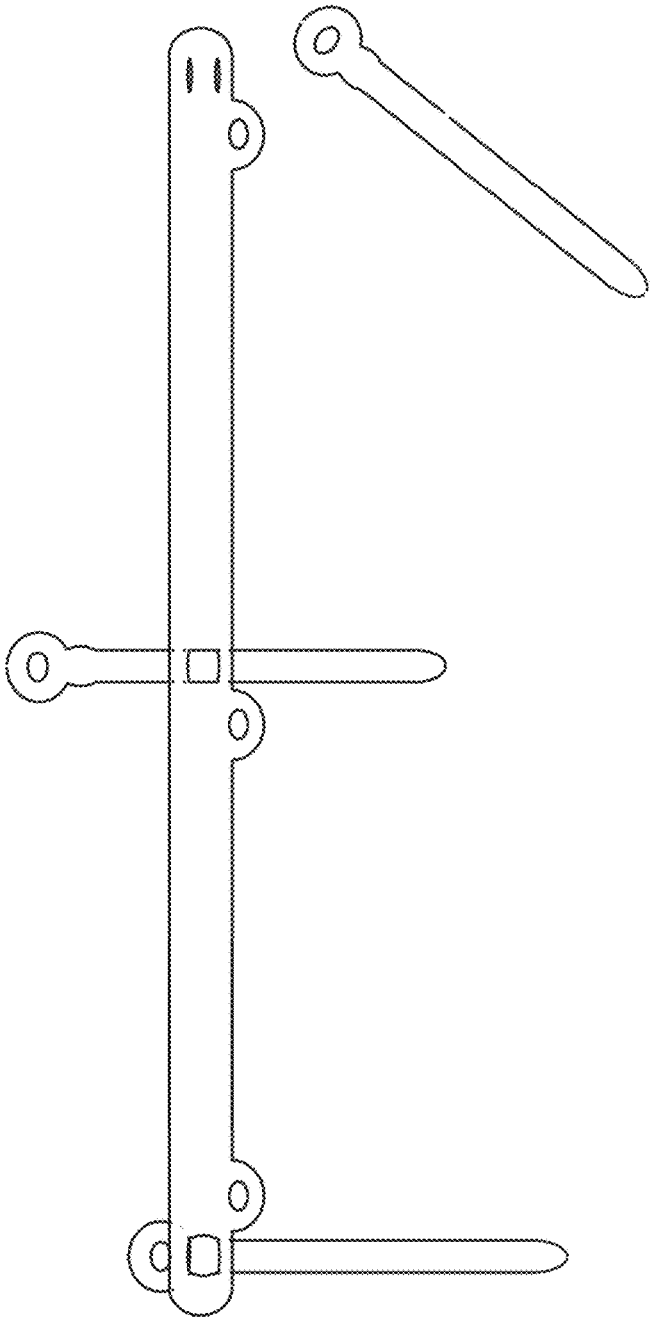
Figure 21B:
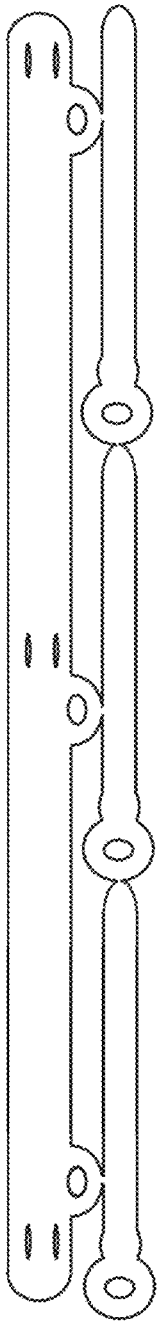

FIGS. 21A and 21B show embodiments of the present invention that are somewhat similar to the embodiments shown in FIGS. 20A and 20B. However the embodiments shown in FIGS. 21A and 21B have additional sets of cuts and additional openings beyond the two sets of cuts and two openings of the embodiments in FIGS. 20A and 20B. Some alternative embodiments may have more sets of cuts and more openings. Some embodiments may have more than one opening per set of cuts. Some embodiments may have more than one set of cuts per opening. In some embodiments a tie may pass through a set of cuts both before and after it passes through an opening.

Thus, embodiments of the disclosed invention can provide various benefits compared to conventional binding devices and related methods. For example, in some embodiments, binding devices according to the invention can be quickly and economically manufactured and can secure assembled materials having a wide range of thicknesses, while exhibiting generally small overall profiles.

While not being bound to a single theory, the embodiments described herein provide improved devices and methods for creating a binding device from flexible sheets of materials. Generally, the binding devices include a tie, at least one opening, and (optionally) one or more fasteners. The tie, when passed through the first opening, can remain at an acute angle, such as by way of engagement with a second opening or a fastener. The acute angle of the tie results in a stopping force via the application of a force (i.e., friction) against the edge of the opening. Maintaining the acute angle with a second opening or fastener prevents the tie from dislodging from the first opening, thereby retaining the target material in the desired position (i.e., bound).

The previous description of the disclosed embodiments is provided to enable any person skilled in the art to make or use the invention. Various modifications to these embodiments will be readily apparent to those skilled in the art, and the generic principles defined herein may be applied to other embodiments without departing from the spirit or scope of the invention. Thus, the invention is not intended to be limited to the embodiments shown herein but is to be accorded the widest scope consistent with the principles and novel features disclosed herein.

The invention claimed is:

1. A binding device for hole-punched paper or other items, the binding device comprising:
- a flexible sheet comprising a sheet substrate;
- a tie that extends from the sheet substrate;
- a first opening in the sheet substrate; and
- a second opening in the sheet substrate;
- wherein the tie:
  - forms a securing loop;
  - extends from the securing loop along the sheet substrate in a first direction to pass through the first opening from a first side of the first opening to a second side of the first opening; and
  - on the second side of the first opening, acutely bends to extend along the sheet substrate in a second direction from the first opening to the second opening and pass through the second opening, wherein the second direction is at an acute angle relative to the first direction within a plane defined by the sheet substrate, the securing loop being thereby configured to secure the hole-punched paper or other items.

2. The binding device of claim 1, wherein the tie between the first opening and the second opening remains substantially parallel to the plane defined by the sheet substrate.

3. The binding device of claim 1, further comprising:
- a third opening in the sheet substrate;
- wherein the first, second, and third openings are arranged in a nonlinear arrangement,
- wherein, to secure the hole-punched paper or other items, the tie extends from the second opening along the sheet substrate in a third direction to pass through the third opening, the third direction being at an acute angle relative to the second direction within the plane of the sheet substrate.

4. The binding device of claim 3, further comprising:
- a fourth opening in the sheet substrate;
- wherein, to secure the hole-punched paper or other items, the tie extends from the third opening along the sheet substrate in a fourth direction that is at an acute angle relative to the third direction, from the third opening to the fourth opening, and passes through the fourth opening.

5. The binding device of claim 4, further comprising:
- a fifth opening in the sheet substrate;
- wherein the tie is configured to further secure the hole-punched paper or other items by extending from the fourth opening along the sheet substrate in a fifth direction that is at an acute angle relative to the fourth direction, from the fourth opening to the fifth opening.

6. The binding device of claim 1, wherein the first opening is formed on the sheet substrate and the second opening is formed on a flap of the sheet substrate.

7. The binding device of claim 6, wherein the tie extends from the first opening towards the second opening on a first side of the sheet substrate, and extends away from the second opening on the first side of the sheet substrate.

8. The binding device of claim 6, wherein the flap is attached to the sheet substrate at an edge opposite to an incoming direction of the tie when the tie extends through the second opening.

9. A binding device of claim 1 wherein each of the first and second openings have at least one side cut allowing access to an inner area of the respective opening.

10. The binding device of claim 1, wherein the tie is monolithic with the sheet substrate.

11. The binding device of claim 1, wherein a width of the widest portion of at least one of the first opening or the second opening is substantially the same as a width of the tie, and opposite sides of the tie are configured to engage inner edges of the at least one of the first or second openings to secure the tie within the at least one of the first or second openings.

12. The binding device of claim 1, wherein the binding device is integrally formed with multiple leaves; and wherein at least one of the leaves includes the first opening and the second opening.

13. A binding device comprising:
- a flexible sheet comprising a sheet substrate having openings in a nonlinear arrangement relative to a first direction;
- a tie that extends from the sheet substrate; and
- one or more flaps that extend from the sheet substrate, and include corresponding one or more of the openings of the sheet substrate;
- wherein the tie:
  - extends from the sheet substrate to form a loop;
  - extends from the loop through a first of the openings;
  - extends from the first opening along the sheet substrate to pass through a second of the openings; and
  - extends from the second opening to pass through a third of the openings,
  - with the tie entering the second opening in the first direction and exiting the second opening at an acute angle relative to the first direction to secure the tie at the second opening.

14. The binding device of claim 13, wherein the second opening is located on a first flap of the one or more flaps and the third opening of the at least two openings is located on a second flap of the one or more flaps.

15. The binding device of claim 13, wherein a first flap of the one or more flaps has a cut edge between the at least one of the flaps and the sheet substrate so that the first flap has a base end that is part of and connects monolithically with the sheet substrate, and a free end that is opposite the base end, is separated from the sheet substrate, and angles out of a plane of the sheet substrate to receive the tie.

16. The binding device of claim 15, wherein the second opening is located on a first flap of the one or more flaps, and wherein the tie extends from the first opening along a first side of the sheet substrate to the second opening passes through the second opening, and, extends from the second opening to the third opening on the first side of the sheet substrate.

17. The binding device of 13, wherein the tie and the flexible sheet are included monolithically in the binding device.

18. A method for manufacturing a binding device for hole-punched paper or other items, the method comprising:

forming a tie;

forming a sheet substrate into a flexible sheet with an arrangement of a first opening and a second opening relative to a first direction, in which the first opening is spaced apart from the second opening in a second direction that forms an acute angle relative to the first direction within a plane defined by the sheet substrate;

wherein, the first direction is an insertion direction of the tie, with the tie secured at a tie location to extend from the sheet substrate to form a securing loop, such that the tie:

extends from the securing loop along a side of the sheet substrate in the first direction to pass through the first opening; and the tie exits the first opening and acutely bends relative to the first direction to extend from the first opening along the sheet substrate in the second direction and pass through the second opening.

19. The method of claim 18, wherein forming the sheet substrate includes forming at least one of the first opening or the second opening on a respective flap that is cut from and extends monolithically from the sheet substrate.

20. The method of claim 18, wherein the tie and the flexible sheet are formed monolithically from the sheet substrate.

* * * * *